US011841645B2

(12) United States Patent
Koyama et al.

(10) Patent No.: US 11,841,645 B2
(45) Date of Patent: Dec. 12, 2023

(54) TONER CONVEYING DEVICE AND IMAGE FORMING APPARATUS

(71) Applicant: CANON KABUSHIKI KAISHA, Tokyo (JP)

(72) Inventors: Fuyuko Koyama, Kanagawa (JP); Norihiro Matsumoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/730,309

(22) Filed: Apr. 27, 2022

(65) Prior Publication Data

US 2022/0350275 A1 Nov. 3, 2022

(30) Foreign Application Priority Data

Apr. 30, 2021 (JP) ..... 2021-077366
Feb. 7, 2022 (JP) ..... 2022-017269

(51) Int. Cl.
*G03G 15/08* (2006.01)

(52) U.S. Cl.
CPC ..... *G03G 15/0889* (2013.01); *G03G 15/087* (2013.01); *G03G 15/0891* (2013.01)

(58) Field of Classification Search
CPC ..... G03G 15/0889; G03G 15/087; G03G 15/0891; G03G 21/105; G03G 15/161; G03G 2221/1624; G03G 2215/0802; G03G 2215/085; G03G 2215/1661
See application file for complete search history.

(56) References Cited

U.S. PATENT DOCUMENTS

| | | | | |
|---|---|---|---|---|
| 7,881,633 | B2 | 2/2011 | Sakuma | |
| 10,635,022 | B2 | 4/2020 | Ishii | |
| 2019/0302652 | A1* | 10/2019 | Hamada | G03G 15/087 |
| 2020/0257236 | A1* | 8/2020 | Mizutani | G03G 15/0891 |

FOREIGN PATENT DOCUMENTS

| | | | |
|---|---|---|---|
| JP | 2001331039 | A | 11/2001 |
| JP | 2005128430 | A | 5/2005 |
| JP | 2009086479 | A | 4/2009 |
| JP | 2019174724 | A | 10/2019 |

* cited by examiner

*Primary Examiner* — Sandra Brase
(74) *Attorney, Agent, or Firm* — ROSSI, KIMMS & McDOWELL LLP

(57) ABSTRACT

A toner conveying device includes a container, a rotating member having a protruding portion inside the container, and a stirring member of toner. A first region and a second region on the opposite side are provided inside the rotation trajectory of the rotating member in a state without contact with the inner surface of the container. The protruding portion is provided between a first position in which a second straight line that is perpendicular to a first straight line that divides the rotation trajectory and passes through the center of the rotating member and is in the second region, and a second position in which a third straight line that is perpendicular to a contact line passing through a contact point between the container and the stirring member, passes through the center at the time of deformation of the stirring member and is in the second region.

23 Claims, 19 Drawing Sheets

TONER CONVEYING DEVICE AND IMAGE FORMING APPARATUS

BACKGROUND OF THE INVENTION

Field of the Invention

The present invention relates to a toner conveying device and an image forming apparatus including the toner conveying device.

Description of the Related Art

An electrophotographic image forming apparatus (hereinafter referred to as an image forming apparatus) such as a printer using an electrophotographic process may be provided with a toner conveying device for conveying toner. For example, a toner conveying device is provided in order to convey the toner to be supplied to a developing device, or to collect the toner remaining on the image bearing member, such as a photosensitive drum or a transfer belt, after image formation and then convey the collected toner. A toner conveying device is known in which a stirring member that stirs the stored toner, a conveying member for conveying the toner to and from a toner container, and the like, are provided inside the toner container.

In the configuration disclosed in Japanese Patent Application Publication No. 2019-174724, a film-shaped stirring member is provided on a rotating shaft in a toner container, and the tip of the stirring member rotates while sliding on the inner surface of the toner container in a state of being bent and in contact with the inner surface of the toner container.

SUMMARY OF THE INVENTION

In such a configuration, the rotating shaft is often made of a resin, and the rotating shaft may be bent by the reaction force which the stirring member received from the inner surface of the toner container depending on the rigidity of the rotating shaft, the thickness of the stirring member, the distance between the tip of the stirring member and the inner surface of the toner container, and the like. Further, in long-term storage in a high-temperature environment in a state in which the stirring member receives a reaction force from the inner surface of the toner container in this manner, the rotating shaft may undergo creep deformation. Where the rotating shaft has bent in a direction away from the inner surface of the toner container due to creep deformation, the toner conveying force of the rotating shaft and the conveying member may decrease.

Therefore, an object of the present invention is to provide a toner conveying device and an image forming apparatus making it possible to stabilize the toner conveying force for a long period of time.

In order to achieve the above object, the toner conveying device of the present invention includes the following:

a container configured to accommodate toner;

a rotating member that is rotatably provided inside the container and extends in a direction of a rotation axis of the rotating member, the rotating member having a protruding portion that protrudes in a direction perpendicular to the direction of the rotation axis; and a flexible sheet-shaped stirring member provided on the outer periphery of the rotating member and fixed at one end portion to the rotating member, the stirring member being capable of stirring the toner by rotating of the rotating member, wherein the stirring member comes into contact with the inner surface of the container and deforms as the rotating member rotates, wherein in a rotation trajectory formed by the rotation of the rotating member in a case where the rotating member is viewed in a cross section orthogonal to the rotation axis, wherein a line segment connecting a free end of the stirring member in a state, in which the free end is in contact with the inner surface of the container and is not deformed, and the rotation center of the rotating member is defined as a radius of the rotation trajectory, in a case where a phase, in which the free end is in contact with the inner surface of the container and is deformed, is defined as a first phase, and a phase, in which the free end is not in contact with the inner surface of the container is defined as a second phase, where a region, in which the free end is arranged in a state in which the free end is located in the first phase in a case where the rotation trajectory is divided into two by a first straight line, which is parallel to the stretching direction of the stirring member and passing through the rotation center of the rotating member, is defined as a first region, and a region on an opposite side to the first region across the first straight line is defined as a second region, wherein the protruding portion is partially provided in the circumferential direction of the rotating member, and at least a part of the protruding portion is provided between a first position in which a second straight line that is perpendicular to the first straight line and passes through the rotation center of the rotating member crosses the rotation trajectory and is located in the second region in the rotation direction of the rotating member, and a second position in which, in a case the rotation trajectory divided in two by a third straight line, the third straight line is crossed the rotation trajectory and is located in the second region, and in the first phase, the straight line that is perpendicular to a contact line passing through a contact point formed by the inner surface of the container and the stirring member in a state of deformation of the stirring member, passes through the rotation center and crosses the rotation trajectory is defined as the third straight line, wherein the container has a contact portion with which the stirring member comes into contact on the inner surface, and wherein the protruding portion protrudes from the outer peripheral surface of the rotating member toward the inner surface of the container, the protruding portion is provided in a region on a substantially opposite side to the contact portion on the outer peripheral surface of the rotating member, across the rotation axis, and the protruding portion is in contact with the inner surface in a case where the rotating member is stopped and the stirring member is in contact with the contact portion.

In order to achieve the above object, the image forming apparatus of the present invention further includes the following:

an image forming portion including an image bearing member that bears a toner image and a transfer unit for transferring the toner image from the image bearing member to a transfer target;

a cleaning unit for removing the toner from the image bearing member; and a toner collecting device that collects the toner removed from the image bearing member by the cleaning unit, wherein the toner collecting device includes the toner conveying device of the present invention.

According to the present invention, the toner conveying force of the toner conveying device can be stabilized for a long period of time.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Image Forming Apparatus

Figure 1:
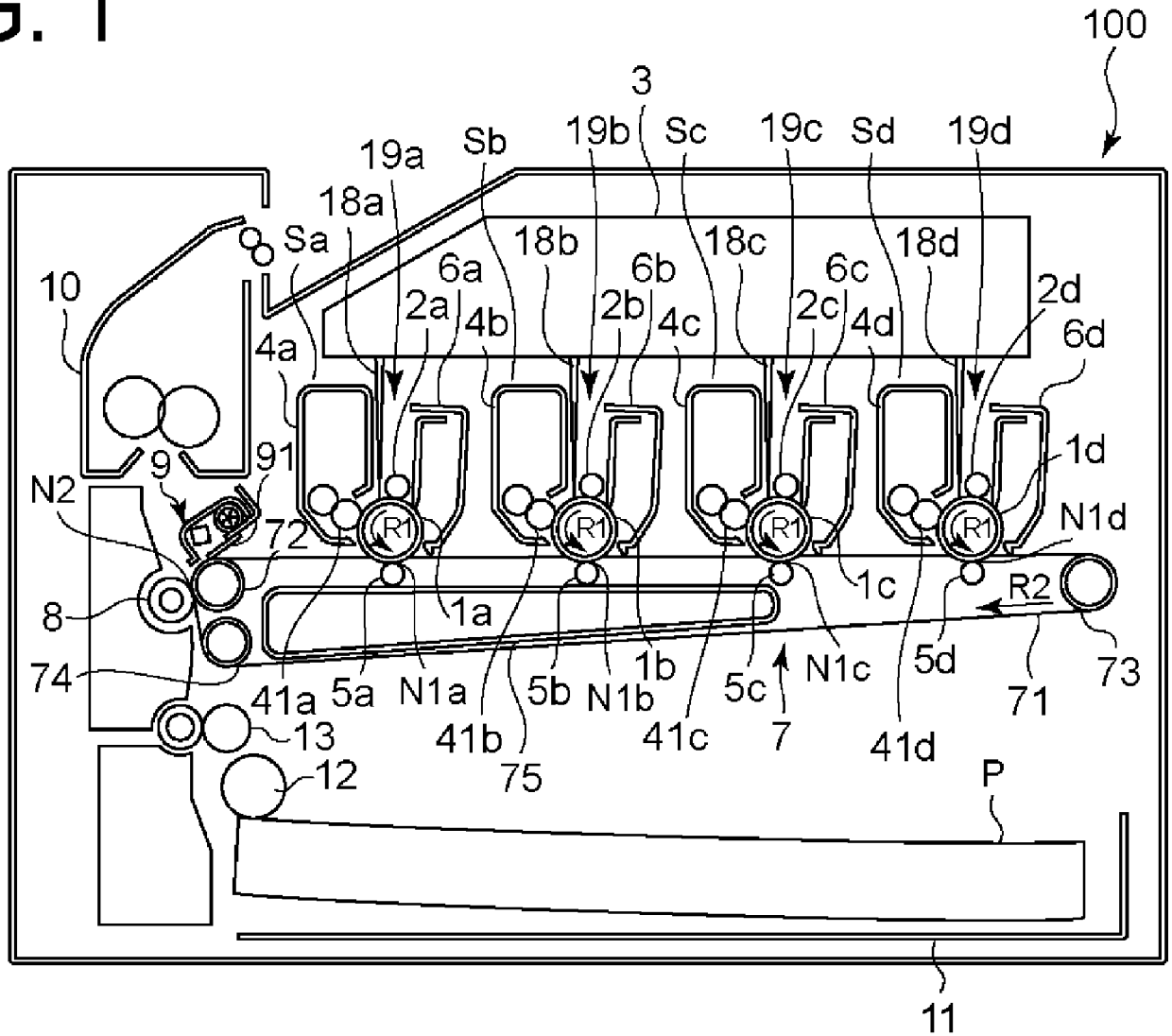
FIG. 1 is a schematic cross-sectional view showing a schematic configuration of an image forming apparatus according to the present embodiment.

FIG. 1 is a schematic cross-sectional view showing the configuration of an image forming apparatus 100 of the present embodiment. The image forming apparatus 100 of the present embodiment is a so-called tandem type image forming apparatus (full-color laser printer) provided with a plurality of image forming portions Sa to Sd. The first image forming portion Sa forms an image with a yellow (Y) toner, the second image forming portion Sb forms an image with a magenta (M) toner, the third image forming portion Sc forms an image with a cyan (C) toner, and the fourth image forming portion Sd forms an image with a black (Bk) toner. These four image forming portions are arranged in a row at regular intervals, and most of the configurations of the image forming portions are substantially common except for the color of the toner to be accommodated therein. Therefore, in the following description, if no particular distinction is required, the subscripts a, b, c, and d given to the reference numerals in the figures to indicate that the elements are provided for the respective colors will be omitted, and general explanation will be given.

The image forming portion S (Sa, Sb, Sc, Sd) includes a photosensitive drum 1 (1*a*, 1*b*, 1*c*, 1*d*) which is a drum-shaped photosensitive member, a charging roller 2 (charging roller 2*a*, 2*b*, 2*c*, 2*d*) as a charging member for charging the photosensitive drum 1, a developing unit 4 (4*a*, 4*b*, 4*c*, 4*d*), and a drum cleaning unit 6 (6*a*, 6*b*, 6*c*, 6*d*) (cleaning device). In the present embodiment, the photosensitive drum 1, the charging roller 2, the developing unit 4, and the drum cleaning unit 6 are integrally formed into a cartridge and constitute a process cartridge 19 (19*a*, 19*b*, 19*c*, 19*d*) that can be detachably attached to the main body of the image forming apparatus 100.

The photosensitive drum 1 is an image bearing member that bears a toner image, and is rotationally driven at a predetermined process speed in the direction of arrow R1 shown in the figure. The developing unit 4 accommodates toner as a developer (a non-magnetic one-component developer in the present embodiment), and has a developing roller 41 (41*a*, 41*b*, 41*c*, 41*d*) as a developing member for developing a toner image on the photosensitive drum 1 with the toner, and a developing coating blade (not shown) as a developer regulating member. The toner accommodated in the developing unit 4 is borne on the developing roller 41 at a position where the developing coating blade and the developing roller 41 face each other, and then the toner is conveyed to the portion (development portion) where the photosensitive drum 1 and the developing roller 41 face each other as the developing roller 41 rotates.

The drum cleaning unit 6 is for collecting the toner adhering to the photosensitive drum 1. The drum cleaning unit 6 has a cleaning member such as a fur brush or a cleaning blade that comes into contact with the photosensitive drum 1, and a waste toner container that houses the toner or the like removed from the photosensitive drum 1 by the cleaning member.

An exposure unit 3 can be configured by a laser scanner unit that scans the laser beam with a multi-sided mirror, an LED array, or the like, but in the present embodiment, the laser scanner unit is used. Although the details will be described hereinbelow, the exposure unit 3 forms an electrostatic latent image on the surface of the photosensitive drum 1 by irradiating the photosensitive drum 1 with a scanning beam 18 (18*a*, 18*b*, 18*c*, 18*d*) modulated based on an image signal.

Where an image forming operation is started by a control unit (not shown) receiving the image signal, the photosensitive drum 1 is rotationally driven. During the rotation process, the photosensitive drum 1 is uniformly charged to a predetermined potential (charging potential) with a predetermined polarity (negative in the present embodiment) by the charging roller 2 to which a voltage is applied from a charging power source (not shown), and the scanning beam 18 corresponding to the image signal is emitted from the exposure unit 3. As a result, an electrostatic latent image corresponding to each color component image of the target color image is formed in each image forming portion S. Next, the electrostatic latent image is developed at the developing position by a developing roller 41 to which a voltage is applied from a developing power source (not shown), and the latent image is visualized as a toner image on the photosensitive drum 1.

Here, in the present embodiment, the regular charging polarity of the toner contained in the developing unit 4 is negative. In the present embodiment, the electrostatic latent image is reverse-developed with a toner charged to the same polarity as the charging polarity of the photosensitive drum 1 charged by the charging member 2, but the present invention can also be applied to an image forming apparatus in which an electrostatic latent image is positively developed with the toner charged to the polarity opposite to the charging polarity of the photosensitive drum 1.

An intermediate transfer belt 71 (image bearing member) as an endless and movable intermediate transfer member is arranged at a position where it comes into contact with each photosensitive drum 1 of each image forming portion S, and is stretched by three rollers, namely, a drive roller 72, a tension roller 73 and a driven roller 74 as tension members. The intermediate transfer belt 71 is stretched in a state where a predetermined tension is applied by the tension roller 73, and moves in the direction of arrow R2 in the figure by the rotation of the drive roller 72 that rotates by receiving a driving force. Although the details will be described hereinbelow, the intermediate transfer belt 71 in the present embodiment is composed of a plurality of layers.

The toner image formed on the photosensitive drum 1 is primarily transferred to the intermediate transfer belt 71 in the process of passing through a primary transfer portion N1 (N1*a*, N1*b*, N1*c*, N1*d*) in which the photosensitive drum 1 and the intermediate transfer belt 71 are in contact with each other. At this time, a voltage having a polarity (positive in the present embodiment) opposite to the regular charging polarity of the toner is applied to the primary transfer roller 5 (5*a*, 5*b*, 5*c*, 5*d*) from a primary transfer power supply (not shown). After that, the toner that has not been primarily transferred to the intermediate transfer belt 71 and remains on the photosensitive drum 1 is collected by the drum cleaning unit 6 and removed from the surface of the photosensitive drum 1. Here, the primary transfer roller 5 is a primary transfer member (contact member) that is provided at a position corresponding to the photosensitive drum 1 with the intermediate transfer belt 71 interposed therebetween and is in contact with the inner peripheral surface of the intermediate transfer belt 71.

In this way, the toner images of each color formed in each image forming portion S are sequentially transferred in superposition with each other to the intermediate transfer belt 71 in each primary transfer portion N1. As a result, a four-color toner image corresponding to the target color image is formed on the intermediate transfer belt 71.

A transfer material P (recording material) as a transfer member loaded in a paper feed cassette 11 as an accommodating portion is fed by a paper feed roller 12 and then conveyed by the conveying roller 13 according to the formation of the electrostatic latent image on the photosensitive drum 1 by the exposure unit 3. Then, the transfer material P is conveyed by the conveying roller 13 to a secondary transfer portion N2 at the timing when the four-color toner image borne on the intermediate transfer belt 71 reaches the secondary transfer portion N2 formed by the contact between the secondary transfer roller 8 and the intermediate transfer belt 71. After that, the four-color toner image borne on the intermediate transfer belt 71 is integrally secondarily transferred to the surface of the transfer material P such as paper or OHP sheet fed by the paper feed roller 12.

The secondary transfer roller 8 is in contact with the outer peripheral surface of the intermediate transfer belt 71, and a pressure of 50 N is applied to the drive roller 72 arranged at a position facing the secondary transfer roller 8, with the intermediate transfer belt 71 interposed therebetween, to form the secondary transfer portion N2. The four-color toner image borne on the intermediate transfer belt 71 is integrally secondarily transferred to the surface of the transfer material P in the process of passing through the secondary transfer portion N2. At this time, a voltage having a polarity (positive in the present embodiment) opposite to the regular charging polarity of the toner is applied to the secondary transfer roller 8 from a secondary transfer power source (not shown). The configuration related to this secondary transfer corresponds to the transfer unit of the present invention.

The transfer material P to which the four-color toner image is transferred by the secondary transfer is then heated and pressurized in a fixing device 10 as a fixing unit, so that the four-color toners are melt-mixed and fixed to the transfer material P. The toner remaining on the intermediate transfer belt 71 after the secondary transfer is cleaned and removed by the cleaning unit 9 (collecting unit) provided on the downstream side of the secondary transfer portion N2 in the movement direction of the intermediate transfer belt 71.

The cleaning unit 9 is a collecting member that is in contact with the outer peripheral surface of the intermediate transfer belt 71 at a position facing the drive roller 72, and has an elastic cleaning blade 91 formed of urethane rubber or the like. The toner collected from the surface of the intermediate transfer belt 71 by the cleaning blade 91 is conveyed toward a collecting container 75 provided in the region formed by the inner peripheral surface of the intermediate transfer belt 71, and is collected in the collecting container 75. In the following description, the cleaning blade 91 is simply referred to as a blade 91. The blade 91 is arranged at a position facing the drive roller 72 with the intermediate transfer belt 71 interposed therebetween. Further, the blade 91 is in contact with the intermediate transfer belt 71 in the counter direction with respect to the movement direction of the intermediate transfer belt 71. The details of the cleaning unit 9 and the collecting container 75 will be described hereinbelow.

In the image forming apparatus 100 of the present embodiment, a full-color printed image is formed by the above operation.

Here, in the image forming apparatus 100 of the present embodiment, the transfer material P is conveyed in the vertical upward direction with respect to the secondary transfer portion N2 in the direction of gravity. In the present embodiment, as shown in FIG. 1, the cleaning unit 9 is arranged above the drive roller 72 in the direction of gravity.

Further, in the image forming apparatus 100 of the present embodiment, the intermediate transfer belt 71, the cleaning unit 9, and the collecting container 75 are integrally unitized and configured to be detachably attachable as the intermediate transfer unit 7 to the apparatus main body of the image forming apparatus 100.

Hereinabove, as an explanation of the image forming operation in the image forming apparatus 100 of the present embodiment, an example of forming an image using four image forming portions Sa to Sd has been described. However, the image forming apparatus 100 can also form a single color or a full color image by performing image formation using a desired single or plurality of (but not all) image forming portions S.

Intermediate Transfer Unit

Figure 2:
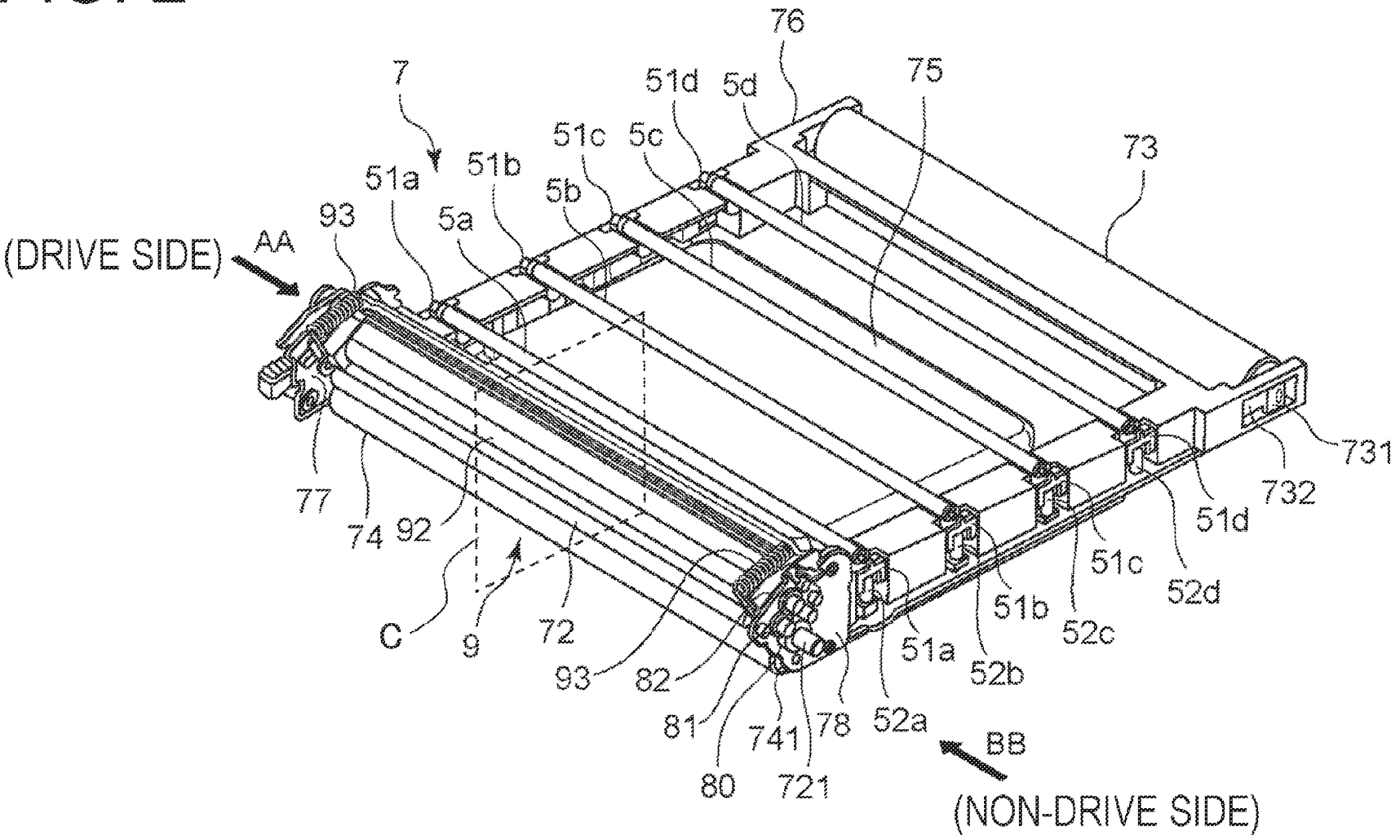
FIG. 2 is a schematic perspective view showing a schematic configuration of an intermediate transfer unit.
Figure 3A:
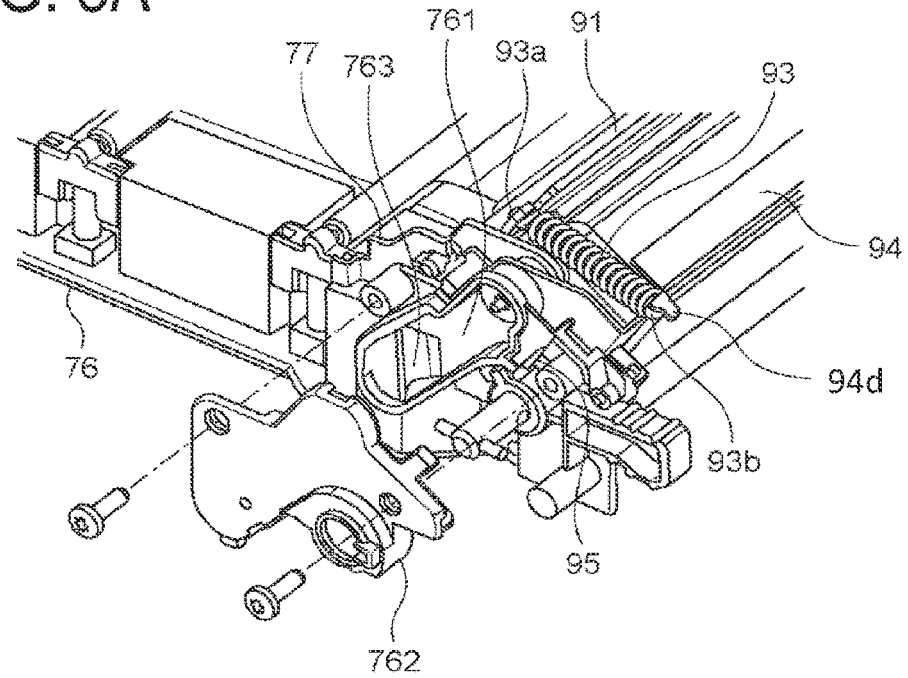
FIGS. 3A and 3B are schematic diagrams showing the drive-side configuration of the intermediate transfer unit.
Figure 3B:
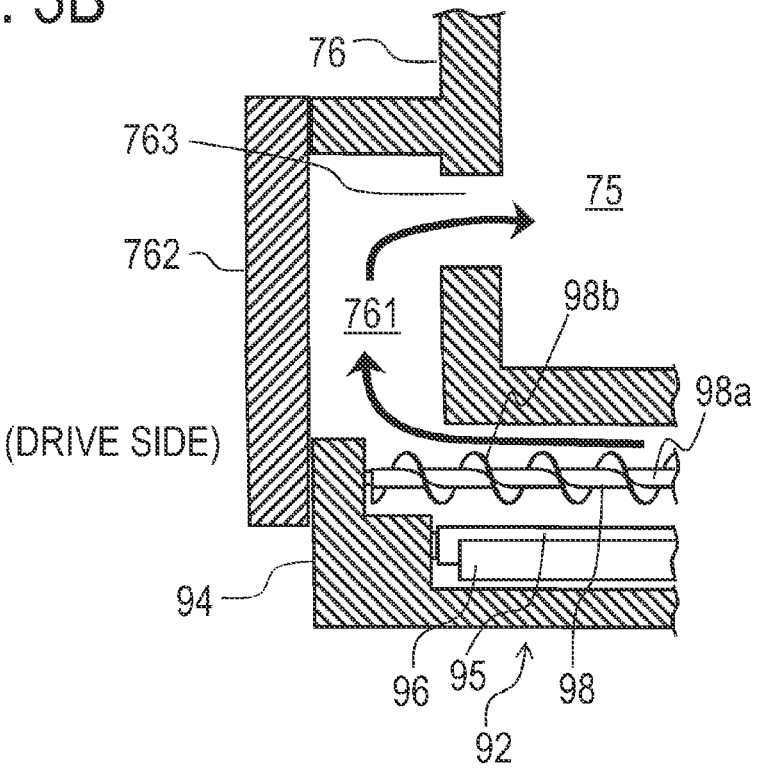
Figure 4:
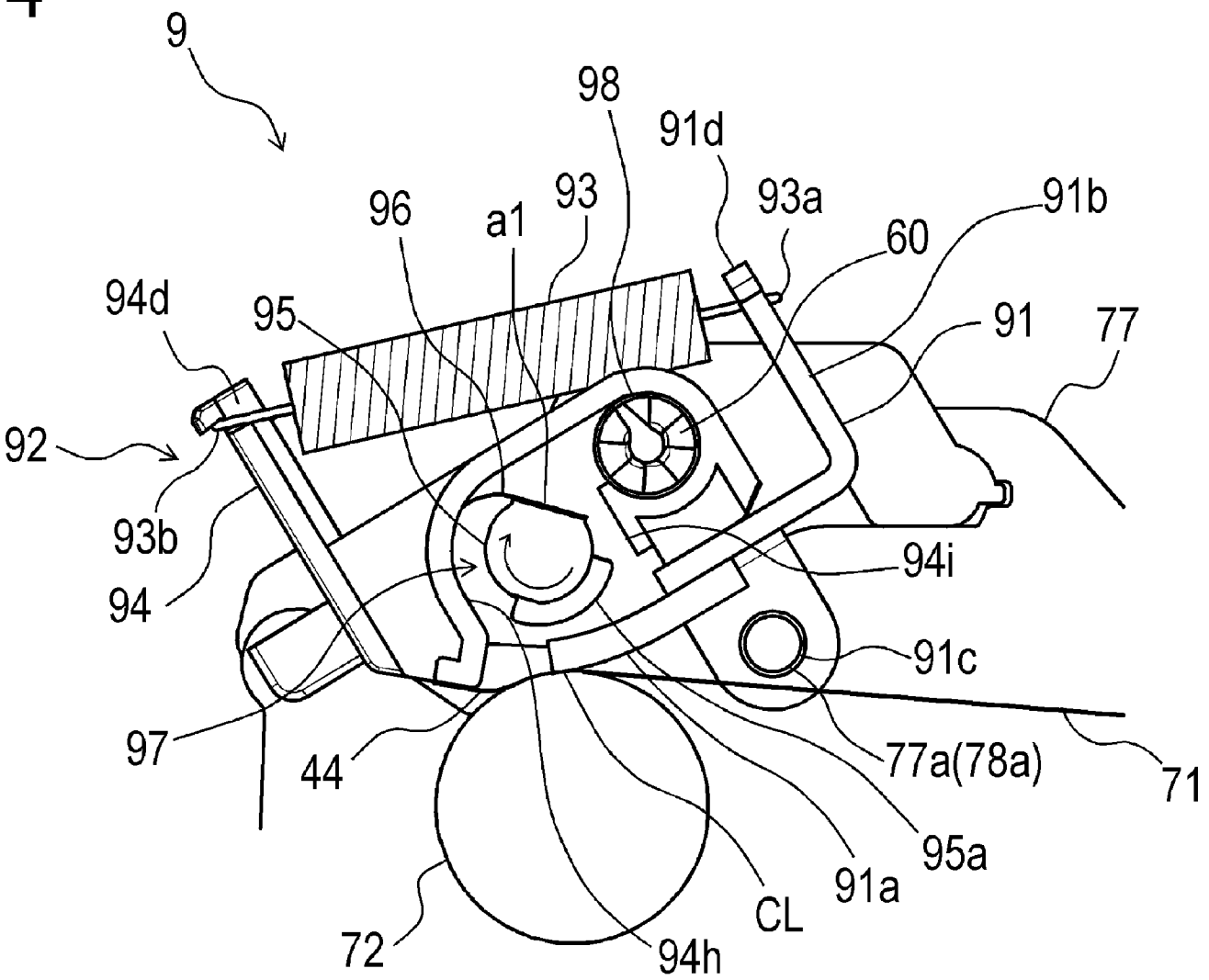
FIG. 4 is a schematic cross-sectional view showing a schematic configuration of a cleaning unit.

The configuration of the intermediate transfer unit 7 will be described with reference to FIGS. 2, 3A, 3B, and 4. FIG. 2 is a schematic perspective view showing a schematic configuration of the intermediate transfer unit 7. Here, the intermediate transfer belt 71 is not shown in FIG. 2 for the sake of simplicity. FIG. 3A is a schematic view of the intermediate transfer unit 7 of FIG. 2 when viewed from the direction of arrow AA (AA side) in the figure. This is a simple exploded schematic diagram illustrating the configuration of the cleaning unit 9. FIG. 3B is a schematic cross-sectional view showing a schematic configuration of a toner conveyance path that reaches an inlet 763 of the collecting container 75 from the inside of a toner conveying portion 92 via a toner conveyance path 761. Further, FIG. 4 is a schematic cross-sectional view of the cross section C of the intermediate transfer unit 7 shown in FIG. 2 when viewed from the direction of the arrow BB shown in the figure.

As shown in FIG. 2, in the intermediate transfer unit 7, the intermediate transfer belt 71 is stretched and supported by three tension rollers, namely, the drive roller 72, the tension roller 73, and the driven roller 74. Both ends of the drive roller 72 are rotatably supported by bearings 721, and the drive roller 72 is rotated by the transmission of a predetermined rotational drive force from the apparatus main body to one end side in the direction of the rotation axis. In the following description, the drive-transmitted side is referred to as a drive side (downstream side in the arrow AA direction in FIG. 2), and the opposite side is referred to as a non-drive side (downstream side in the arrow BB direction in FIG. 2). Further, in the present embodiment, the drive roller 72 is obtained by press-fitting a metal shaft such as SUS into both ends of a pipe having a diameter of about 25 mm and obtained by coating a rubber in which carbon is dispersed as a conductive agent on an aluminum core metal.

Further, in the present embodiment, an aluminum metal rod having a diameter of about 25 mm is used as the tension roller 73, and bearings 731 are provided at both ends in the direction of the rotation axis of the tension roller 73. When the bearings 731 are urged by compression springs 732, both ends of the tension roller 73 are urged, and a predetermined tension is applied to the intermediate transfer belt 71. Similarly to the tension roller 73, the driven roller 74 uses a metal rod made of aluminum, and both ends thereof are rotatably supported by bearings 741.

The primary transfer roller 5 is provided at a position corresponding to the photosensitive drum 1 with the intermediate transfer belt 71 interposed therebetween. The primary transfer roller 5 is supported by bearings 51 (51*a*, 51*b*, 51*c*, 51*d*) at both ends in the direction of the rotation axis, urged toward the intermediate transfer belt 71 with a predetermined force by compression springs 52 (52*a*, 52*b*, 52*c*, 52*d*) via the bearings 51, and driven to rotate as the intermediate transfer belt 71 rotates. Further, in the present embodiment, as the primary transfer roller 5, a roller having a diameter of about 6 mm and having a metal shaft such as SUS is used. At least one of the bearings 51 provided on both ends is made of a conductive member, and by applying a voltage of positive polarity positive to the primary transfer roller 5 from a primary transfer power source (not shown), the toner image is primarily transferred from the photosensitive drum 1 to the intermediate transfer belt 71.

Further, as the material of the intermediate transfer belt 71, rubber, resin, or the like can be used as appropriate. In the present embodiment, the intermediate transfer belt 71 is an endless belt-shaped film formed of a resin material having medium resistivity and thickness of about 60 μm in the thickness direction that is orthogonal to the movement direction of the intermediate transfer belt 71 and the rotation axis direction of each tension roller.

A frame 76 is a frame body of the intermediate transfer unit 7 for supporting each tension roller and uses a molded resin material. The bearings 51 at both ends that support the primary transfer roller 5 and the bearings 731 at both ends that support the tension roller 73 are supported by the frame 76 in a state of being movable in the pressurizing direction of each compression spring with respect to the frame 76.

In the vicinity of the drive roller 72 supported by the frame 76, a support plate 77 and a support plate 78 that rotatably support the drive roller 72 and the driven roller 74, respectively, via respective bearing, are provided. The support plate 77 and the support plate 78 are fixed to the frame 76 by screws or the like on the respective ends of the drive roller 72 in the rotation axis direction in a positioned state. In the present embodiment, a pressed sheet metal is used as the support plate 77 and the support plate 78.

Although details will be described hereinbelow, as shown in FIGS. 2 to 4, the cleaning unit 9 serving as a toner collecting device has the blade 91 as a cleaning member and the toner conveying portion 92 that collects and conveys the toner removed by the blade 91 from the intermediate transfer belt 71. The blade 91 and the toner conveying portion 92 are fixed to the support plate 77 and the support plate 78, respectively, in a positioned state.

The toner removed from the intermediate transfer belt 71 by the blade 91 is temporarily stored inside the toner conveying portion 92. Then, as shown in FIG. 3B, after being conveyed inside the toner conveying portion 92, the toner is collected into the collecting container 75 through the toner conveyance path 761 provided on the drive side of the frame 76. As shown in FIG. 3A, the toner conveyance path 761 is sealed by fastening a conveyance path cover 762 to a container body 94 with screws or the like, and the toner is prevented from leaking to the outside in the intermediate transfer unit 7.

The collecting container 75 is composed of molded resin parts and is configured as a container sealed on the outer circumference by adhesively bonding a plurality of resin parts. The collecting container 75 is fixed to the frame 76 with screws or the like. Further, the collecting container 75 is provided with a detection unit (not shown), for example, an optical sensor or the like for detecting whether the container is full with the toner. This makes it possible to notify the user of the replacement time of the collecting container 75. The collecting container 75 full with the toner can be replaced with a new one by a serviceman or a user by replacing the intermediate transfer unit 7.

Cleaning Unit

As shown in FIGS. 2 to 4, as described above, the cleaning unit 9 has the blade 91 as a cleaning member and the toner conveying portion 92 for temporarily storing the toner removed from the intermediate transfer belt 71 by the blade 91 and conveying the collected toner to the collecting container 75. As shown in FIG. 4, the blade 91 has an elastic urethane rubber 91*a* and a holding sheet metal 91*b* to which the urethane rubber 91*a* is bonded. With respect to the longitudinal direction of the urethane rubber 91*a* (direction of the rotation axis of the drive roller 72), the length of the urethane rubber 91*a* is set to be longer than the image forming region in which the toner image can be borne on the intermediate transfer belt 71. Further, the blade 91 is arranged in pressure contact with the intermediate transfer belt 71, and it is possible to remove the toner remaining on the intermediate transfer belt 71.

Here, in order to reliably remove the toner, it is necessary to press the blade 91 against the intermediate transfer belt 71 with a predetermined pressure. In the present embodiment, the above-mentioned predetermined pressure is ensured by arranging the blade 91 to face at least one of the plurality of tension rollers on which the intermediate transfer belt 71 is stretched. More specifically, the blade is arranged to face and be in contact with the drive roller 72 at a position on the downstream side of the secondary transfer portion N2 in the movement direction of the intermediate transfer belt 71 and at a position above the drive roller 72 in the gravity direction.

A hole 91*c* for rotatably supporting the blade 91 and a spring hook portion 91*d* for hanging a pressurizing spring for pressing the blade 91 against the intermediate transfer belt 71 are provided at both ends of the holding sheet metal 91*b* in the longitudinal direction of the blade 91. The blade 91 is engaged with metal blade support shafts 77*a* and 78*a* crimped to the support plate 77 and the support plate 78, respectively, through the holes 91*c* at both ends, and is rotatably supported in a state in which the blade can be freely brought into contact with and separated from the intermediate transfer belt 71.

Further, the spring hook portions 91*d* provided at both longitudinal ends of the blade 91 and spring hooks 94*d* provided at both longitudinal ends of the container body 94 constituting the toner conveying portion 92 are engaged with hooks 93*a* and hooks 93*b*, respectively, provided at both ends of the tension springs 93 in the expansion/contraction direction. More specifically, as shown in FIGS. 3A, 3B, and 4, the spring hook portion 91*d* engages with the hook 93*a*, and the spring hook portion 94*d* engages with the hook 93*b*, whereby the spring hook portion 91*d* and the spring hook portion 94*d* are bridged by the tension spring 93. As a result, the tension spring 93 generates a moment around the hole 91*c*, and the blade 91 is pressed against the intermediate transfer belt 71 with a predetermined pressure.

In the toner conveying portion 92, in order to prevent the toner collected from the intermediate transfer belt 71 from leaking to the outside from the container body 94, a plurality of sealing members (not shown) is attached to the container body 94 with a double-sided tape or the like. Further, a sheet member 44 that is in contact with the intermediate transfer belt 71 and seals a gap between the toner conveying portion 92 and the intermediate transfer belt 71 is provided on the upstream side of a cleaning portion CL where the blade 91 and the intermediate transfer belt 71 come into contact with each other in the movement direction of the intermediate transfer belt 71. The sheet member 44 as a sealing member is arranged so as to extend in the width direction of the intermediate transfer belt 71. With these configurations, the toner temporarily stored in the toner conveying portion 92 is conveyed from the cleaning unit 9 to the collecting container 75 without leaking to the outside.

Toner Conveyance in Toner Conveying Portion

As shown in FIG. 4, the toner conveying portion 92 serving as a toner conveying device includes a container body 94, a stirring unit 97, and a screw 98. The container body 94 is configured to temporarily accommodate the toner removed by the blade 91. The stirring unit 97 is composed of a rotating shaft 95 as a rotating member rotatably provided inside the container body 94, and a flexible sheet-shaped stirring member 96 and serves to stir and convey the toner housed in the container body 94. The screw 98 has a rotating shaft 98*a* arranged in parallel with the rotating shaft 95 of the stirring unit 97, and a blade portion 98*b* spirally extending on the outer circumference of the rotating shaft 98*a* with respect to the axis thereof (see FIG. 3B). The screw 98 is a conveying member that is rotated to convey the toner housed in the container body 94 to the collecting container 75.

The toner removed from the intermediate transfer belt 71 by the blade 91 after passing through the secondary transfer portion N2 is accumulated in the cleaning portion CL where the blade 91 and the intermediate transfer belt 71 come into contact with each other, or around the sheet member 44 in the toner conveying portion 92. Then, the toner accumulated in the toner conveying portion 92 is supplied to the screw 98 while being stirred by the rotating stirring unit 97.

Figure 5:
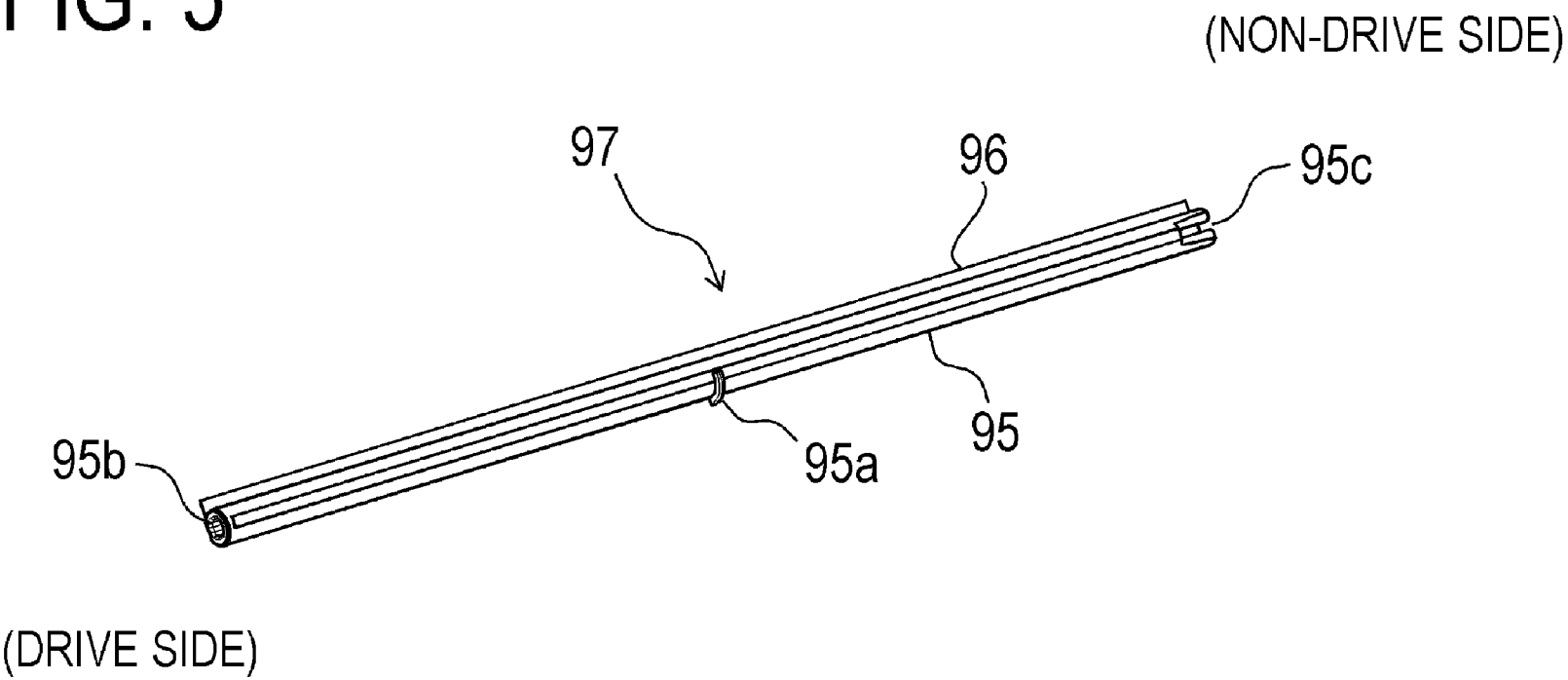
FIG. 5 is a schematic perspective view showing a configuration of a stirring unit.

The configuration of the stirring unit 97 will be described with reference to FIG. 5. FIG. 5 is a perspective view of the stirring unit 97. As described above, the stirring unit 97 is composed of the rotating shaft 95 and the stirring member 96. The rotating shaft 95 is made of a resin member and is provided, on one end side in the rotation axis direction, with a hole 95*b* to be engaged with a shaft (not shown) located in the container body 94, and provided, on the other end, with an engaging portion 95*c* to be engaged with a gear 82 shown in FIG. 2. The rotating shaft 95 rotates in the clockwise direction in FIG. 4 by sequentially transmitting a driving force from a gear 80, a gear 81, and the gear 82 arranged on the shaft parallel to the drive roller 72. As shown in FIG. 4, the rotating shaft 95 has at least one flat surface portion a1 which is parallel to the axial direction, and one end side of the stirring member 96 is fixed to the flat surface portion a1 by a double-sided tape or the like (not shown). The stirring member 96 is a flexible sheet member such as PET having a thickness of about 80 μm, is configured to extend over the entire inside of the toner conveying portion 92 in the longitudinal direction of the blade 91, and rotates together with the rotating shaft 95. Further, a protruding portion 95*a* is provided in a part in the circumferential direction at a substantially central portion in the longitudinal direction of the rotating shaft 95.

Figure 6:
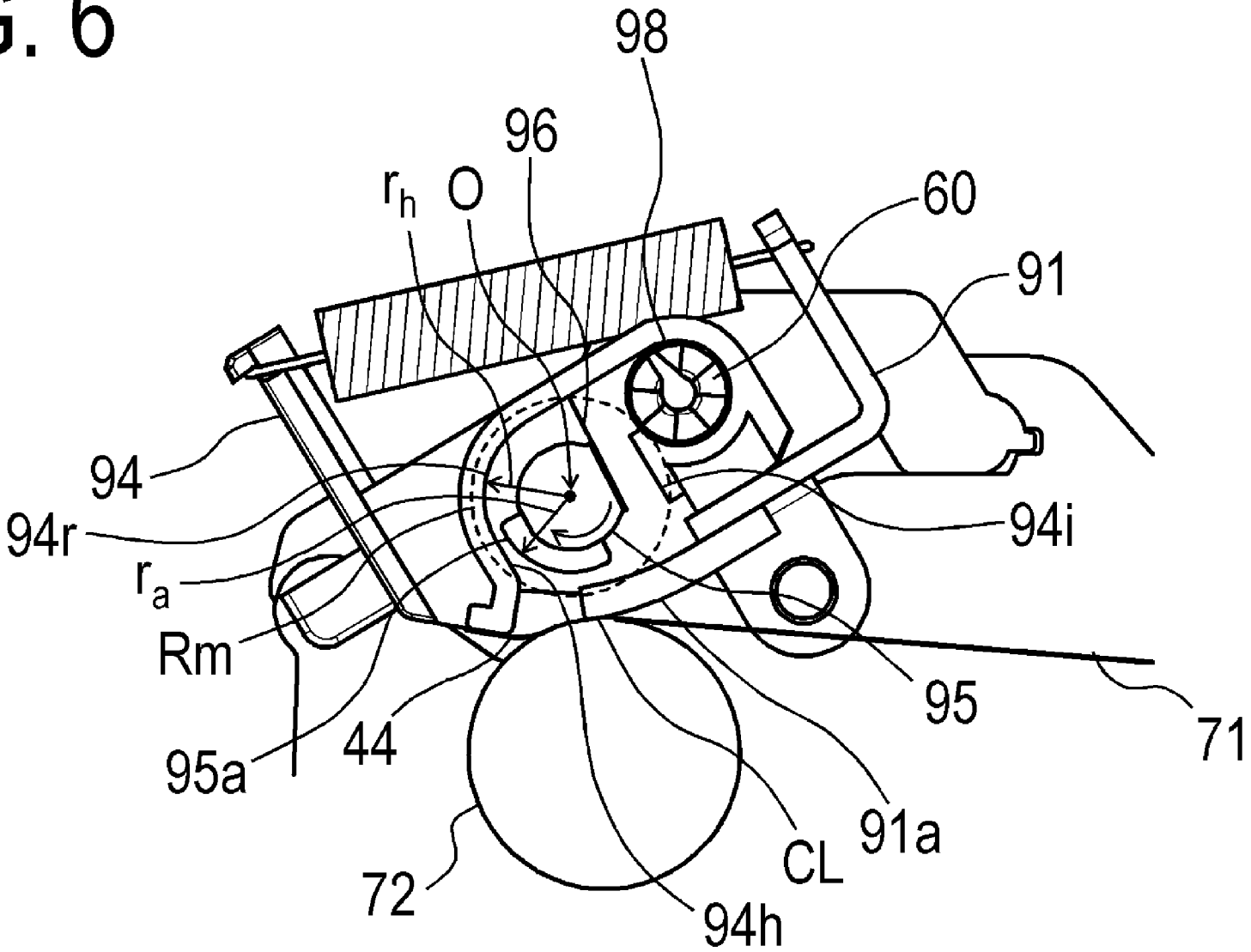
FIG. 6 is a schematic cross-sectional view showing a schematic configuration of the cleaning unit.
Figure 7A:
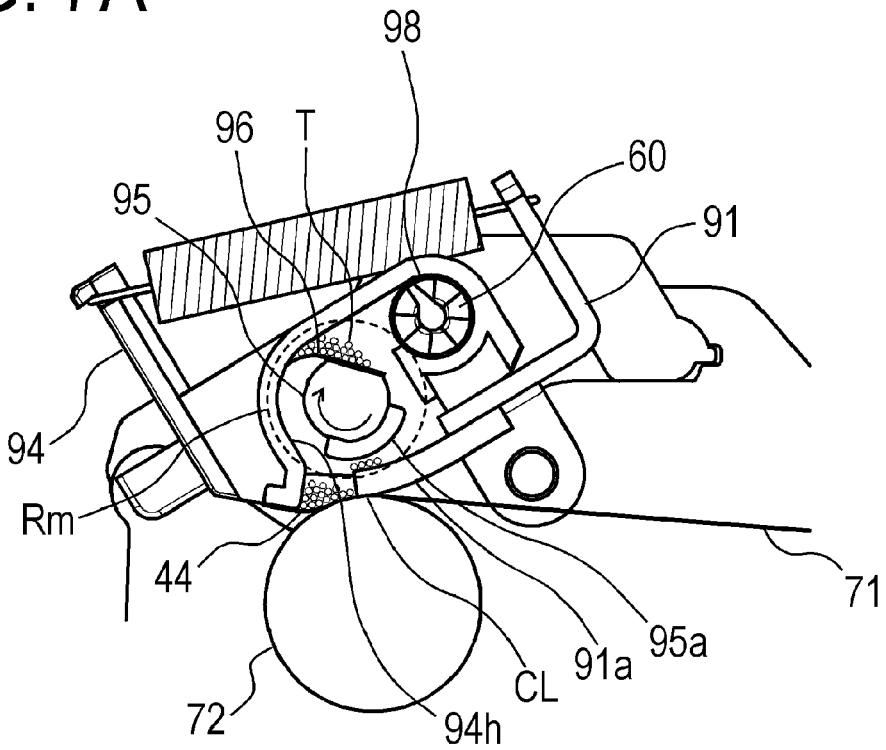
FIGS. 7A and 7B are schematic cross-sectional views of the cleaning unit showing toner conveyance.
Figure 7B:
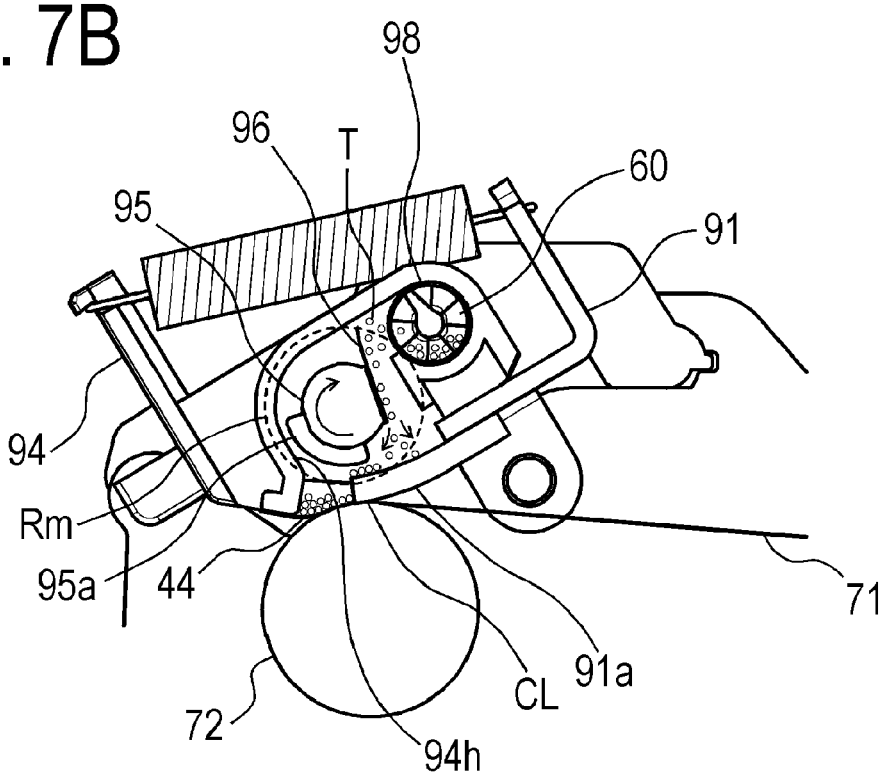

A mechanism of supplying toner to the screw 98 by the stirring unit 97 will be described with reference to FIGS. 6, 7A, and 7B. FIG. 6 is a schematic cross section showing a state at the moment when the end of the stirring member 96 on the free end side is separated from an inner wall 94*h*, which is a part of the container body 94, when viewed from the rotation axis direction of the rotating shaft 95. This cross section corresponds to the cross section when the cross section C of FIG. 2 is seen from the direction of the arrow BB in the figure. FIGS. 7A and 7B are schematic cross-sectional views illustrating the conveyance of toner when viewed from the same direction as in FIG. 6. FIG. 7A shows a state in which the inner wall 94*h*, which is a part of the container body 94, and the stirring member 96 are in contact with each other, that is, the first phase (sliding phase), and FIG. 7B shows a state in which the contact of the inner wall 94*h* with the stirring member 96 is released, that is, a second phase (non-sliding phase).

The inner surface of the container body 94 (toner conveying portion 92) forming the toner conveyance path (toner accommodation section) has a shape such that the distance to the rotation axis of the rotating shaft 95 in the direction perpendicular to the rotation axis varies (in the direction of rotation of the rotating shaft 95). Due to the change in the inner surface shape of the container body 94, the stirring member 96 is configured to be capable of having a first phase (sliding phase) in which the side of the tip portion (other end portion) which is a free end opposite to the fixed end portion (one end portion) attached to the rotating shaft 95 is in contact with the inner surface of the container body 94 due to the rotation of the rotating shaft 95, and a second phase (non-sliding phase) in which no such contact takes place.

A circle Rm shown in FIG. 6 is a virtual movement trajectory of the free end which is the end portion (tip portion) on the side of the stirring member 96 and which is not fixed to the rotating shaft 95 when the stirring member 96 rotates together with the rotating shaft 95. That is, this is the virtual rotation trajectory of the free end represented by a circle with the radius being the distance from the rotation center of the rotating shaft 95 to the free end of the stirring member 96 in a state where the stirring member 96 is not subjected to an external force due to contact with surrounding parts. Further, the inner wall 94*h* includes a concave curved surface portion 94*r* centered on the rotation center of the rotating shaft 95, and $r_h$ is the radius of the curved surface portion 94*r*. In the state shown in FIG. 6 which corresponds to the moment when the free end of the stirring member 96 separates from the inner wall 94*h*, the free end side is on the rotation trajectory Rm, and in the phase (non-sliding phase) in which the free end does not contact the container body 94, the free end rotates clockwise along the rotation trajectory Rm. Meanwhile, a part of the upper surface portion of the urethane rubber 91*a* in the direction of gravity, the inner wall 94*h* of the container body 94, and a part of the inner wall 94*i* are inside the rotation trajectory Rm as contact portions. Therefore, as shown in FIG. 7A, in the phase (sliding phase) in which the upper surface portion of the urethane rubber 91*a* and the inner wall 94*h* arranged inside the rotation trajectory Rm are opposite to the free end of the stirring member 96, the stirring member 96 comes into contact therewith and rotates while bending.

The free end side of the stirring member 96 that is in contact with the inner wall 94*h* rotates in a deformed state (first state) of being deformed to the upstream side in the rotation direction of the stirring member 96. At this time, since the stirring member 96 rotates while in contact with the inner wall 94*h*, the toner laid on the upper surface of the stirring member 96 is scooped up while being prevented from falling from the inner wall 94*h* side. That is, of the toner accumulated on the sheet member 44, the stirring member 96 scoops up the toner accumulated on the inner side in the radial direction with respect to the rotation trajectory Rm and scrapes off the toner accumulated on the upper surface portion of the urethane rubber 91*a*. The stirring member 96 rotates along the inner wall 94*h* while holding the toner thus collected.

Meanwhile, the toner accumulated near the sheet member 44 on the outer side in the radial direction from the rotation trajectory Rm continues to stay on the upper side of the sheet member 44 in the direction of gravity. When the toner is further collected by the blade 91 in this state, the toner remaining on the sheet member 44 rises in the direction of gravity by being pushed by the toner removed from the intermediate transfer belt 71 by the blade 91. When the toner reaches the inside of the rotation trajectory Rm, the toner is scooped up by the rotating stirring member 96. As a result, the toner remaining on the sheet member 44 is sequentially replaced.

Where the stirring member 96 further rotates clockwise from the position shown in FIG. 7A, the stirring member 96 reaches the phase (non-sliding phase) shown in FIG. 6, and the tip on the free end side separates from the inner wall 94*h*. The free end side of the stirring member 96 separated from the inner wall 94*h* is in a free state (second state) in which the deformation due to contact with the inner wall 94*h* is released as a result or switching from the sliding phase to the non-sliding phase. Then, as shown in FIG. 7B, some of the toner T scooped up by the stirring member 96 is caused to fly from the stirring member 96 toward the screw 98 by the reaction of the stirring member 96 trying to return from the deformed state to the free state. After reaching the screw 98, the flying toner T is conveyed toward the toner conveyance path 761 by the conveying portion 60 of the rotating screw 98. The toner that was not caused to fly by the reaction of the stirring member 96 returning to the free state falls on the top surface of the urethane rubber 91*a* as shown by the arrow in FIG. 7B, and is thereafter scooped up by the stirring member 96 that rotates again.

The toner T conveyed in the conveying portion 60 in the direction of the arrow BB in FIG. 2 with respect to the rotation axis direction of the screw 98 reaches the toner conveyance path 761. As shown in FIG. 3A, the toner conveyance path 761 is formed at a slope angle equal to or larger than the angle at which the toner T falls under its own weight. As a result, as shown in FIG. 3B, the toner T conveyed to the toner conveyance path 761 by the rotation of the screw 98 is conveyed to an inlet 763 of the collecting container 75 by the weight of the toner itself. The toner T conveyed to the inlet 763 is dispersed and filled in the collecting container 75 by a toner dispersing member (not shown) arranged in the collecting container 75 for filling the inside of the collecting container 75 with toner.

Deformation of Stirring Unit

As described above, the stirring member 96 comes into contact with and is deformed by the inner wall 94*h* and the wall 94*i* constituting the toner conveying portion 92 inside the rotation trajectory Rm. At this time, the stirring member 96 and the rotating shaft 95 receive a reaction force from these walls. As described above, since the rotating shaft 95 is a resin member, creep deformation may occur in long-term storage at a high temperature in a state in which a reaction force is received. When the rotating shaft is driven under such circumstances, the rotating shaft 95 rotates in a state of being bent to the side substantially opposite to that of the contact portion between the stirring member 96 receiving the reaction force and the wall 94*i*.

Figure 8A:
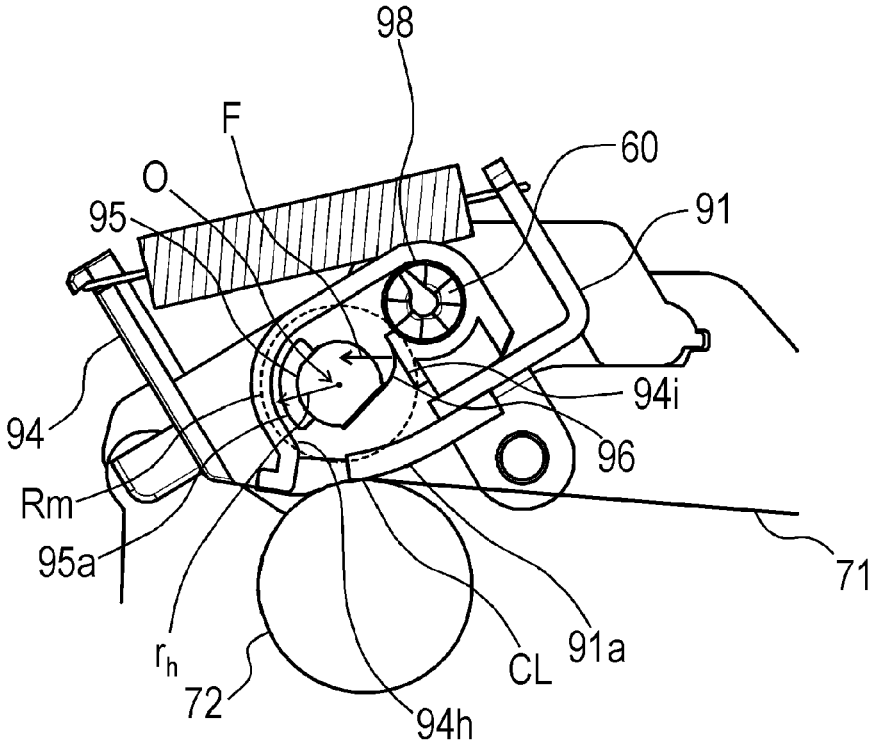
FIGS. 8A and 8B are schematic cross-sectional views showing a schematic configuration of the cleaning unit.
Figure 8B:
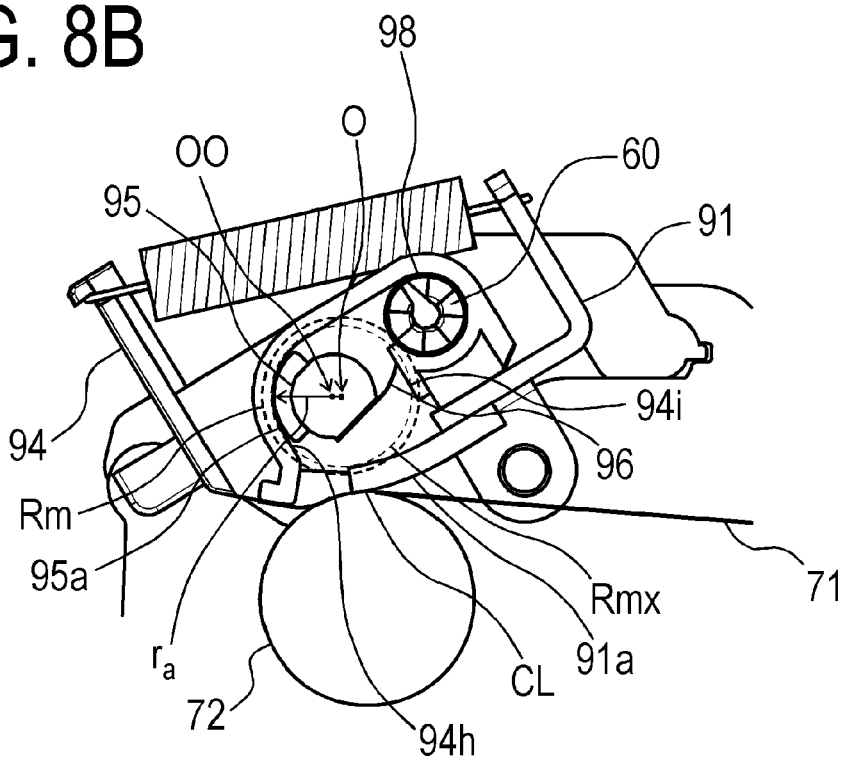

FIG. 8A is a schematic cross-sectional view showing a state in which the stirring member 96 is in contact with the inner wall 94*i* and receives a reaction force F. FIG. 8B is a schematic cross-sectional view illustrating the case in which creep deformation has occurred in the rotating shaft 95 in that state. Point O in FIGS. 8A and 8B is the center of rotation of the rotating shaft 95 in a state without creep deformation.

Here, as described above, a part of the inner wall 94*i* is arranged inside the rotation trajectory Rm. This is done so to bring the conveying portion 60 close to the rotating shaft 95 so that the toner T flying from the stirring member 96 toward the screw 98 could be efficiently delivered to the conveying portion 60. The inner wall 94*i* continuous with the conveying portion 60 is so configured that the end portion of the rotating shaft 95 on the upstream side in the rotation direction is arranged inside the rotation trajectory Rm.

As shown in FIG. 8A, when the stirring member 96 receives a reaction force from the inner wall 94*i*, the rotating shaft 95 to which the stirring member 96 is fixed also receives a force through the stirring member 96. Here, since the rotating shaft 95 is made of resin, creep deformation may occur in long-term storage at a high temperature under a reaction force. In that case, it is considered that the rotating shaft 95 bends at the axially central portion of the rotating shaft in substantially the same direction as the direction of the reaction force F starting from both ends in the axial direction that are rotatably supported. Such a state is shown in FIG. 8B, and FIG. 8B is a cross section at the point where the amount of bending in the axial direction is the largest. Since the deformation of the rotating shaft 95 is due to the reaction of the force that tries to restore the deformed stirring member 96, the point OO that is the center of the rotating shaft 95 in the cross section shown in FIG. 8B is pushed to the side substantially opposite to that of the free end of the stirring member 96. When the rotating shaft 95 rotates in this state, the rotating shaft 95 in the cross section shown in FIG. 8B rotates with the rotation center being deviated by the distance between the point O and the point OO. When the rotating shaft 95 rotates in the state where the center is deviated, the amount of penetration into the upper surface portions of the inner walls 94*h* and 94*i* and the urethane rubber 91*a*, which were in contact during the rotation of the free end of the stirring member 96, is reduced by the deviation amount of the center of rotation.

The circle Rmx shown in FIG. 8B is a virtual movement trajectory of the free end of the stirring member 96 when the stirring member 96 in the cross section of FIG. 8B rotates together with the rotating shaft 95 about the point O as a center. That is, this is the virtual rotation trajectory of the free end represented by a circle with the radius being the distance from the rotation center of the rotating shaft 95 to the free end of the stirring member 96 in a state where the stirring member 96 in the cross section shown in FIG. 8B is not subjected to an external force due to contact with surrounding parts. The radius of the rotation trajectory Rmx is smaller than the radius of the rotation trajectory Rm by the distance between the points O and OO, which is the amount of deviation of the rotation center.

If the amount of bending of the rotating shaft 95 and the amount of deviation of the rotation center are large and the inner wall 94*h* may not enter the inside of the rotation trajectory Rmx, the stirring member 96 and the inner wall 94*h* do not come into contact with each other in the cross section shown in FIG. 8B and a gap is generated therebetween. Further, a gap may open between the stirring member 96 and the wall 94*h* not only in the above cross section, but also in a similar cross section at a position where the bending of the rotating shaft 95 due to creep deformation is large. In such a case, the toner conveying ability maintained by the stirring member 96 coming into contact with the inner wall 94*h* may be impaired, and the toner conveying force may be reduced.

Here, for example, it is conceivable to suppress creep deformation by providing a bearing shape that will support the rotating shaft 95 in a portion where the rotating shaft 95 undergoes large bending. However, where the temperature of the toner rises a certain level or higher, the toner melts and sticks, so it is preferable that the number of sliding portions that generate frictional heat be the minimum necessary. In the rotating shaft 95 in the toner conveying portion 92, the toner that has entered the gap between the supported portion of the rotating shaft 95 and the bearing portion will be continuously rubbed, so that the toner can be melted by the rubbing heat. When the melted toner is solidified again, the toner is fixed to the rotating shaft 95, which may hinder normal rotation.

Therefore, in the present embodiment, as shown in FIGS. 8A and 8B, the protruding portion 95*a* is provided on the rotating shaft 95 at a position substantially opposite to the contact point between the stirring member 96 and the inner wall 94*i* of the toner conveying portion 92 (container body 94). The protruding portion 95*a* protrudes from the outer peripheral surface of the rotating shaft 95 toward the inner wall surface of the toner conveying portion 92 at a position that is substantially opposite to the position of contact between the stirring member 96 in the sliding phase and the inner wall surface of the toner conveying portion 92, with the rotation axis of the rotating shaft 95 being interposed between the two positions. As a result, even when the rotating shaft 95 receives a reaction force from a part inside the toner conveying portion 92 through the stirring member 96, the protruding portion 95*a* is configured to come into contact with the inner wall 94*h* of the toner conveying portion 92 and prevent further deformation.

The bending deformation of the rotating shaft 95 is not limited to the deformation that is constant over time such as the creep deformation described above, and can also include temporary bending deformation and the like that occurs only while the stirring member 96 is in a state of receiving a reaction force from the inner wall of the toner conveying portion 92. That is, depending on the thickness, length, material, etc. of the rotating shaft 95, etc., the thickness, material, etc. of the stirring member 96, and the shape, dimensions, etc. of the inner wall of the toner conveying portion 92, the rotating shaft 95 may be greatly bent in a state of receiving the reaction force from the inner wall of the toner conveying portion 92 when the rotation is stopped. In particular, a deformed posture may be formed in which the longitudinal central portion of the rotating shaft 95 bends relatively significantly. In such a case, the protrusion height of the protruding portion 95*a* from the outer peripheral surface of the rotating shaft 95, the width of the protruding portion in the rotation direction, and the like can be set such that the above-mentioned bending can be suppressed or the degree of bending can be reduced by the protruding portion coming into contact with the inner wall 94*h* of the toner conveying portion 92. Meanwhile, the protruding portion 95*a* can be also configured, for example, such that the bending of the rotating shaft 95 is eliminated or reduced by the stirring member 96 not receiving the reaction force from the inner wall of the toner conveying portion 92 due to the resumption of rotation, and the protruding portion is not in contact with (separated from) the inner wall 94*h* or the degree of contact with the inner wall 94*h* is reduced as compared with that at the time of stopping. Alternatively, the configuration can be such that the protruding portion 95*a* is in contact with the inner wall 94*h* at all times while the stirring member 96 receives a reaction force from the inner wall of the toner conveying portion 92 when the rotating shaft 95 is bent regardless of whether it is stopped or rotated. That is, the protruding portion 95*a* can also be configured to be thrusted against and supported by the inner wall 94*h* at all times while the elastic force is generated in the stirring member 96 by the reaction force received from the inner wall of the toner conveying portion 92. In such a case, it is preferable that a range in which the protruding portion 95*a* is formed on the rotating shaft 95 (a range in which the protruding portion 95*a* slides against the inner wall of the toner conveying portion 92), that is, the size, position, and the like of the protruding portion 95*a*, be minimum necessary and limited so as not to hinder the rotation of the rotating shaft 95.

Figure 18:
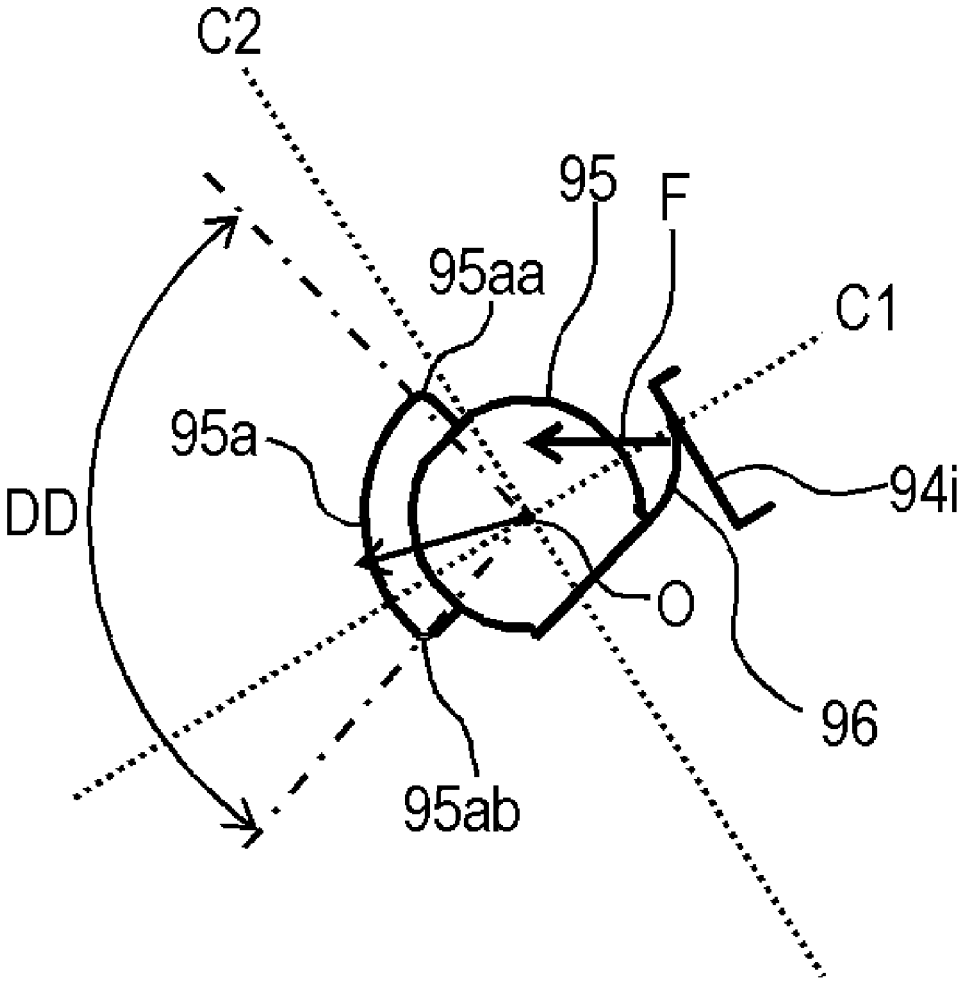
FIG. 18 is an explanatory diagram of the formation position of the protruding portion in Embodiment 1.

FIG. 18 is a schematic diagram for explaining the formation position and formation range of the protruding portion 95*a*, and shows a cross section orthogonal to the rotation axis of the rotating shaft 95 at a longitudinal position (position in the direction of the rotation axis) where the protruding portion 95*a* is provided on the rotating shaft 95. The protruding portion 95*a* is provided on the outer periphery of the rotating shaft 95 in a region on the side substantially opposite to that of the inner wall 94*i*, which forms the contact portion (contact point) with the stirring member 96, with the rotation axis (point O) interposed therebetween. More specifically, the protruding portion 95*a* is formed so as to be located in the region on the side opposite to that where the contact portion is located with respect to a second virtual line C2 orthogonal to a first virtual line C1 passing through the contact portion with the stirring member 96 on the inner wall 94*i* and the rotation axis (point O). The protruding portion 95*a* may be formed so as to include at least a portion located in the region on the opposite side, and the form of the protruding portion outside this region may be arbitrary as long as the rotation of the rotating shaft 95 is not hindered. Further, in the present embodiment, the protruding portion 95*a* is formed with a phase range DD such that the width in the circumferential direction of the outer circumference of the rotating shaft 95 is larger than 90 degrees. That is, the protruding portion is formed such that the angle around the rotation axis (point O) between one end portion 95*aa* and the other end portion 95*ab* in the outer peripheral direction is larger than 90 degrees. Therefore, the protruding portion 95*a* is formed so as to intersect the first virtual line C1 and comes into contact with the inner wall 94*h* at a position that is substantially opposite to the position where the stirring member 96 contacts the inner wall 94*i* with the rotation axis (point O) being interposed between the two positions.

The form of the protruding portion 95*a* shown herein is just an example. At least, the protruding portion may be configured to be located in the region on the side opposite that where the contact portion is located with respect to the second virtual line C2 and to be in contact with the inner wall of the toner conveying portion 92 so that the stirring member 96 can generate a force (a force including a component force acting in the opposite direction) opposite to the reaction force F from the inner wall 94*i* of the toner conveying portion 92. Therefore, the protruding portion 95*a* can be configured such that the abovementioned opposing force can be generated even when the form of the protruding portion is such that, for example, does not intersect the first virtual line C1 and is in the vicinity of the second virtual line C2. Such a form can also be adopted as the form of the protruding portion 95*a*.

In the present embodiment, the protruding portion 95*a* is configured to come into contact with the curved surface portion 94*r*, which is a part of the inner wall 94*h*, in a state where the rotating shaft 95 receives the reaction force F from the inner wall 94*i* through the stirring member 96. The "radius of $Rm-r_h$" shown in FIG. 6 is set to be larger than the "clearance between the protruding portion 95*a* and the curved surface portion 94*r* in a state where the stirring unit 97 is not deformed". Here, the "radius of $Rm-r_h$" is "the amount of penetration of the stirring member 96 into the curved surface portion 94*r* in a state where the stirring unit 97 is not deformed".

That is, when the distance in the radial direction from the center of rotation to the contact portion of the protruding portion 95*a* with the curved surface portion 94*r* is denoted by $r_a$, $$(\text{radius of } Rm-r_h)>(r_h-r_a) \quad (1)$$

$$r_a>(2r_h-\text{radius of } Rm) \quad (2)$$

By setting as described above, the stirring member 96 reliably comes into contact with the curved surface portion 94*r* provided on the inner wall 94*h* even when the rotating shaft 95 receives a reaction force from a part of the toner conveying portion 92 and bends due to creep deformation as shown in FIG. 8B.

Further, as described above, since the toner melts when the temperature rises a certain level or higher, it is preferable that the sliding portions that generate frictional heat be reduced to the minimum necessary. In particular, in the present embodiment, since the fixing device 10 is directly above the cleaning unit 9, the toner in the toner conveying portion 92 is easily affected by the heat generated in the fixing unit. Therefore, it is necessary to further suppress the heat applied to the toner in the toner conveying portion 92. In the present embodiment, by making the protruding portion 95*a* over not the entire area in the rotation direction but only a part thereof, friction heat generated by rubbing of the protruding portion 95*a* with the toner conveying portion 92, and with the toner interposed between the protruding portion and the toner conveying portion 92 is suppressed. In other words, when the rotating shaft 95 is viewed from a cross section orthogonal to the rotation axis, the central angle corresponding to the range of the protruding portion 95*a* provided on the outer periphery of the rotating shaft 95 is set to be smaller than 360°.

Figure 9A:
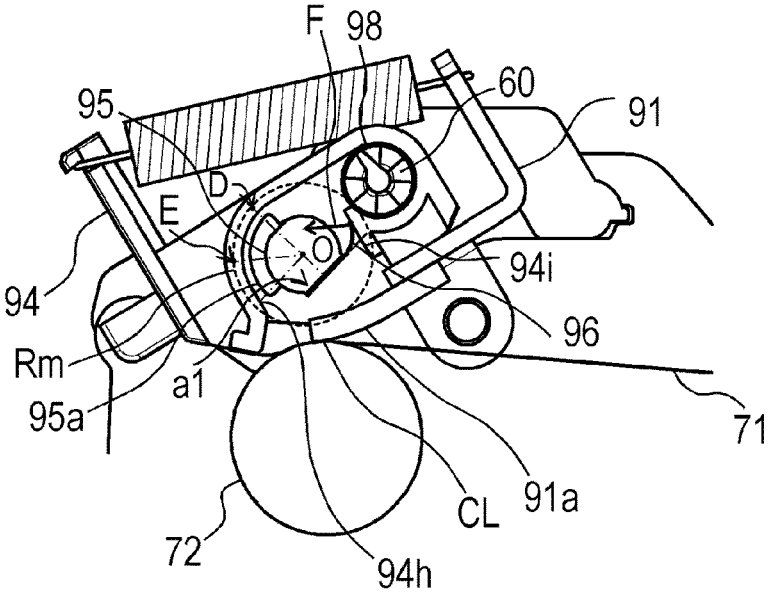
FIGS. 9A to 9C are diagrams showing a rotating shaft and a stirring member of Embodiment 1.
Figure 9B:
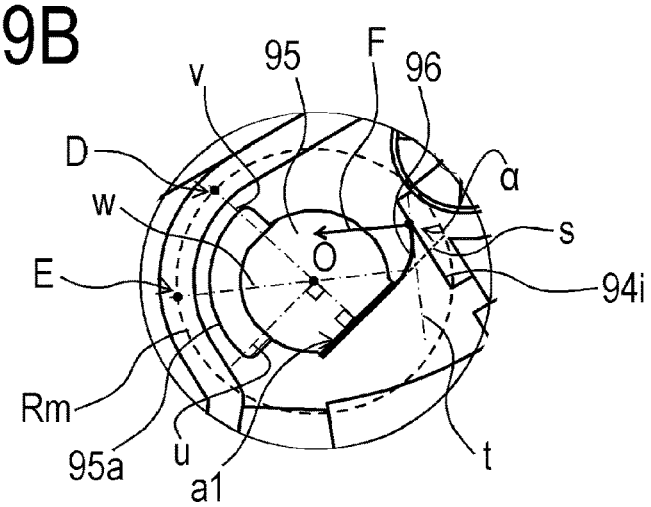
Figure 9C:
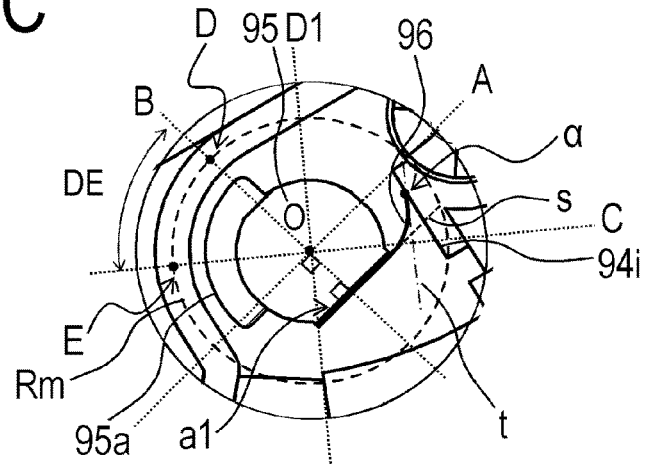

Here, as described above, the rotating shaft 95 is pushed to the side substantially opposite to that of the free end of the stirring member 96 by the reaction force F when the deformed stirring member 96 tries to restore. FIGS. 9A to 9C each show an example of the rotating shaft 95 and the stirring member 96 in a state where the stirring member 96 is in contact with the inner wall 94*i*. FIG. 9B is a partially enlarged view of FIG. 9A. Further, FIG. 9C is an explanatory diagram of a range in which the protruding portion 95*a* of the present embodiment is provided.

The restoring force of the rotating shaft 95 at this time acts between the normal direction to the stretching direction (broken line s in FIG. 9B) of the stirring member 96 in the undeformed state and the normal direction to the tangent in the contact portion end (contact point) a at the time the stirring member 96 contacts the inner wall 94*i*. Therefore, the protruding portion 95*a* may be provided in the following range. That is, a point where a straight line v that passes through the center O of the rotating shaft 95 and is perpendicular to the stretching direction (broken line s in FIG. 9B) of the stirring member 96 in the undeformed state is in contact with the rotation trajectory Rm on the side opposite to the contact portion (contact point) a of the stirring member 96 with the inner wall 94*i* with respect to the central point O of the rotating shaft 95 is denoted by D (first position). A point where a straight line w that is perpendicular to the tangent line (dotted chain line t in FIG. 9B) at the contact portion (contact point) a when the stirring member 96 is in contact with the inner wall 94*i* is in contact with the rotation trajectory Rm on the side opposite to the contact portion of the stirring member 96 with respect to the central point O of the rotating shaft 95 is denoted by E (second position). With such settings, the protruding portion 95*a* may be at least partially between the line segment OE and the line segment OD in the rotation direction of the rotating shaft 95.

Here, the greater the bending of the stirring member 96, the larger the angle between the line segment OE and the line segment OD. In the present embodiment, the stretching direction of the stirring member 96 in the undeformed state is parallel to a flat surface portion a1, the stirring member 96 is in contact with the inner wall 94*i*, and the tangent line at the contact portion (contact point) of the stirring member 96 in the most bent state is substantially perpendicular to the flat surface portion a1 shown in FIG. 4. Therefore, the protruding portion 95*a* in the present embodiment is provided at the position described below. That is, as shown in FIGS. 9A to 9C, the protruding portion 95*a* is provided on the outer periphery of the rotating shaft 95 in a range of approximately 90° from a position that is perpendicular to the flat surface portion a1, with the center O being interposed therebetween, on the side opposite to the flat surface portion a1 in the perpendicular direction with respect to the center O of the rotating shaft 95 to the flat surface portion a1 in the direction opposite to the rotation direction of the stirring member 96.

Further, the range in which the protruding portion 95*a* is provided will be described hereinbelow in another representation. A straight line that passes through the center O of the rotating shaft 95, is parallel to the straight line s, and is perpendicular to the straight line w in FIG. 9C is denoted by u. A straight line passing through the center O of the rotating shaft 95 and including the straight line u is denoted by a first straight line A, a straight line passing through the center O of the rotating shaft 95 and including the straight line v is denoted by a second straight line B, a straight line passing through the center O of the rotating shaft 95 and including the straight line w is denoted by a third straight line C, and a straight line passing through the center O of the rotating shaft 95 and perpendicular to the straight line C is denoted by D1. Further, when dividing into two regions with the straight line A as a boundary, the region including the flat surface portion a1 is defined as the first region, and the region not including the flat surface portion a1 straddling the straight line A from the first region is defined as the second region. At this time, the abovementioned first position D and second position E are located in the second region. Therefore, in this second region, as described above, at least a part of the protruding portion 95*a* may be in the range DE between the line segment OE and the line segment OD.

The fixing device 10 provided with a heating element such as a heater is a particularly typical heat source in the configuration of the image forming apparatus 100, but the heat source that exerts heat on the toner in the image forming apparatus 100 is not limited to the fixing device 10. For example, a motor as a drive source, a control portion including a CPU, a memory, and the like can also be mentioned as heat sources.

Toner melts when it reaches a certain temperature or higher, and it hardens when the temperature drops again. Therefore, the toner stuck to the driving parts may cause damage to the individual parts or the apparatus body. Meanwhile, the configuration of the stirring unit 97 in the present embodiment prevents heat generation due to friction and makes it difficult for the toner inside the toner conveying portion 92 to adhere even when the ambient temperature around the toner conveying portion 92 is high.

The protruding portion 95*a* is provided in a phase range of the phase of the rotation direction of the rotating shaft 95 that includes a phase opposite, with the rotation axis being interposed therebetween, to the action direction of the reaction force received by the stirring member 96 in the sliding phase from the inner surface of the toner conveying portion 92. In the present embodiment, the protruding portion 95*a* is provided so as to protrude from the outer peripheral surface of the rotating shaft 95 in a direction substantially perpendicular to the rotation axis and extend on the outer peripheral surface of the rotating shaft 95 along the rotation direction of the rotating shaft 95. The side surface of the protruding portion 95*a* is perpendicular to the rotation axis of the rotating shaft 95. The shape of the protruding portion 95*a* is not limited to the shape adopted in the present embodiment and may be the one of the shapes of modification examples shown in FIGS. 10A to 10C.

Figure 10A:
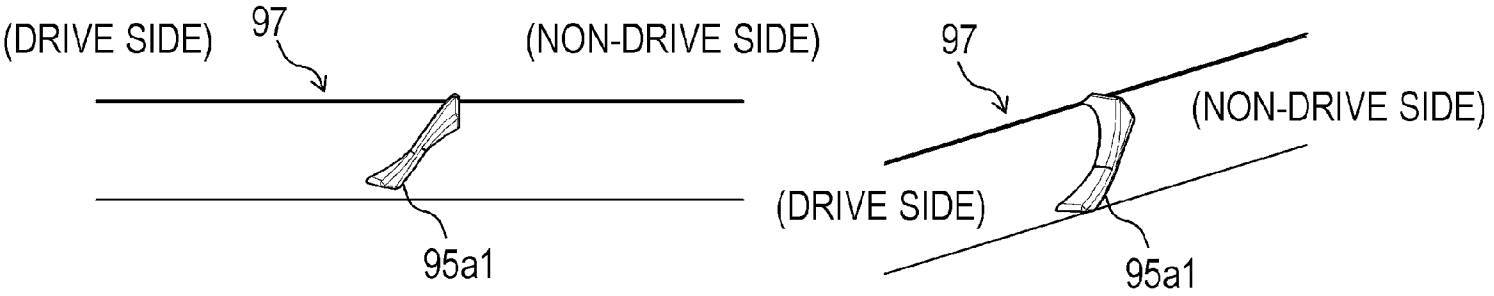
FIGS. 10A to 10C are schematic diagrams showing an example of the shape of a protruding portion.

A protruding portion 95*a*1 of Modification Example 1 shown in FIG. 10A is provided to extend on the outer peripheral surface of the rotating shaft 95 in a substantially spiral manner with respect to the rotation axis and is configured of a curved surface so that the side surface thereof becomes a part of the screw in consideration of conveying ability of the toner in the axial direction. When viewed in the direction (direction of arrow AA in FIG. 2 (second direction)) opposite to the direction in which the screw 98 conveys the toner (direction of arrow BB in FIG. 2 (first direction)), the rotating shaft 95 rotates counterclockwise around the rotation axis. The protruding portion 95*a*1 is inclined so that the position in the rotation direction of the rotating shaft 95 changes from the upstream side to the downstream side in the rotation direction with the transition in the opposite direction.

Figure 10B:
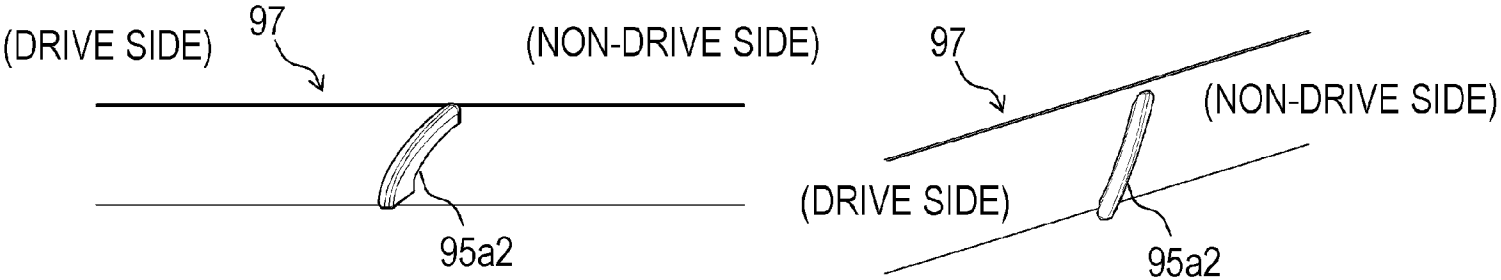

Similar to the protruding portion 95*a*1 of Modification Example 1 shown in FIG. 10A, a protruding portion 95*a*2 of Modification Example 2 shown in FIG. 10B is provided to extend substantially spirally with respect to the rotation direction of the rotating shaft 95 on the outer peripheral surface of the rotating shaft 95 in consideration of conveying ability of the toner in the axial direction. The side surface of the protruding portion 95*a*2 is composed of a flat surface extending in a direction inclined with respect to the direction of the rotation axis and the direction perpendicular to the rotation axis when viewed from the direction perpendicular to the rotation axis of the rotating shaft 95. The inclination direction of the side surface of the protruding portion 95*a*2 takes into consideration the die punching direction, and is parallel to the die punching direction, which is the direction perpendicular to the rotation axis. The shape of the protruding portion 95*a*2 of Modification Example 2 of FIG. 10B will be described in detail in Embodiment 2.

Figure 10C:
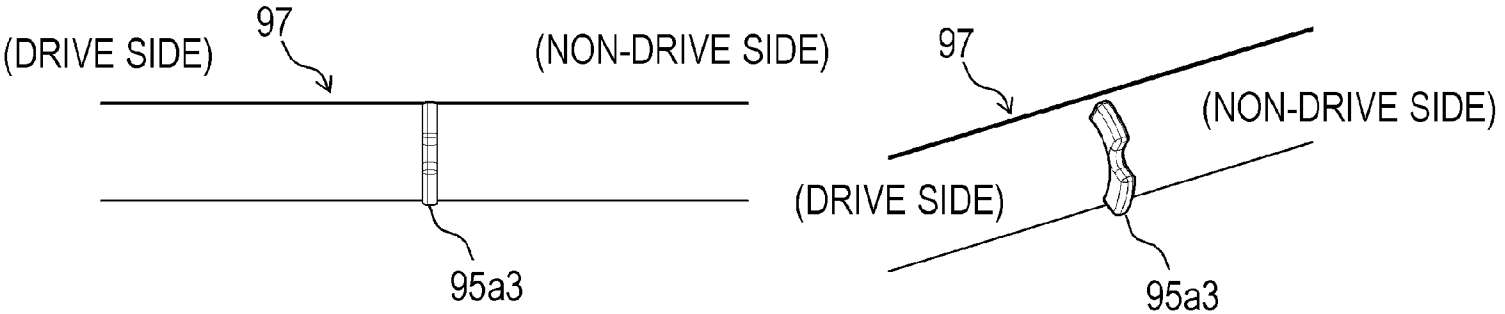

A protruding portion 95*a*3 of Modification Example 3 shown in FIG. 10C has a peak-valley shape having a plurality of projections arranged side by side in an extension direction on the outer peripheral surface of the rotating shaft 95 so that a plurality of peaks of the protrusion height is formed in the extension direction. The number of projections is two in the configuration example shown in FIG. 10C, but three or more projections may be provided, and the distance therebetween (the length of the valley) in the extension direction of the protruding portion 95*a*3 may be set as appropriate. This peak-valley shape may be applied to the protruding portion 95*a* of Modification Example 1 shown in FIG. 10A and the protruding portion 95*a*2 of Modification Example 2 shown in FIG. 9B.

Figure 11A:
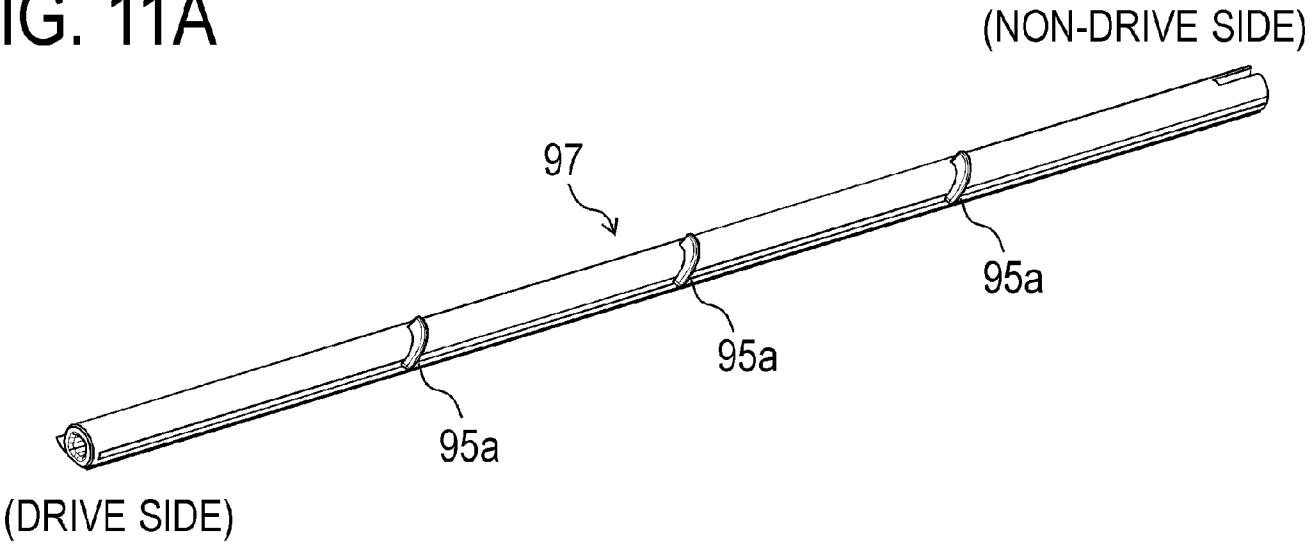
FIGS. 11A and 11B are schematic diagrams showing an example of the shape of the rotating shaft.
Figure 11B:
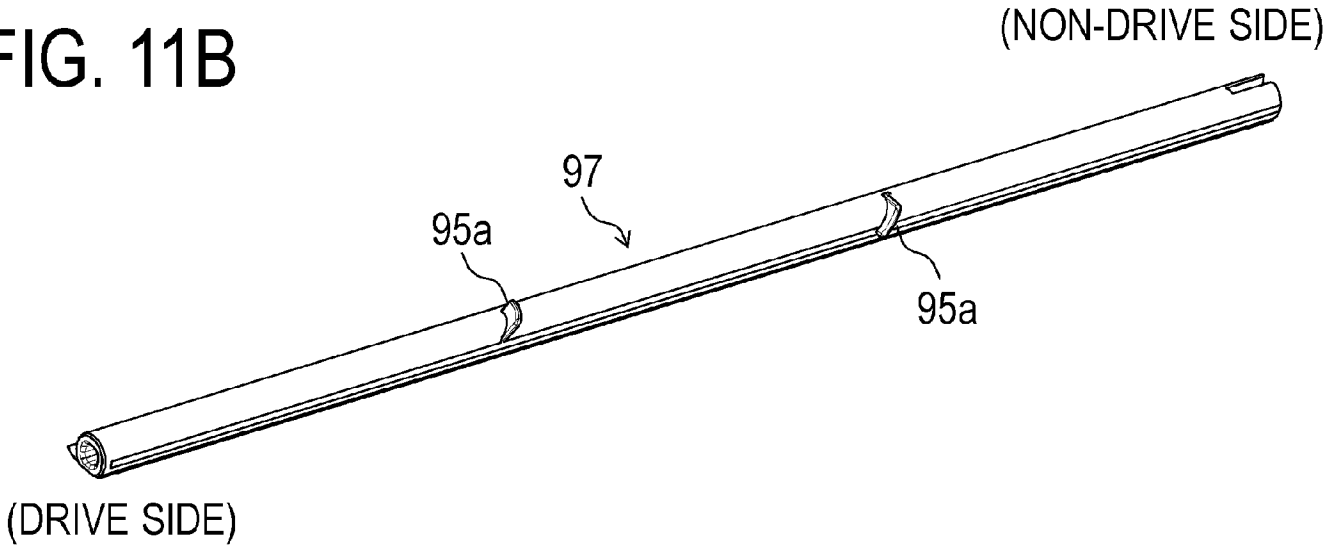

Further, in the present embodiment, the protruding portion 95*a* is provided in the central portion of the rotating shaft 95 in the longitudinal direction (rotational axis direction), but this configuration is not limiting, and as shown in FIGS. 11A and 11B, a plurality of protruding portions 95*a* may be provided. That is, as shown in FIG. 11A, a plurality of protruding portions may be provided not only in the central portion in the longitudinal direction but also at intervals in the longitudinal direction on both sides of the longitudinal direction. Further, as shown in FIG. 11B, a plurality of protruding portions may be provided at locations between the central portion and both end portions in the longitudinal direction. From the viewpoint of preventing the rotating shaft 95 from bending, it is preferable to provide the protruding portions in the vicinity of the central portion away from both ends in the longitudinal direction.

In the configuration shown in FIG. 11A, the plurality of protruding portions 95*a* are arranged in the same phase, but in the configuration shown in FIG. 11B, the plurality of protruding portions are arranged in different phases. With the configuration shown in FIG. 11B, rather than having one protruding portion 95*a* in contact the inner wall 94*h* to prevent deformation, a plurality of protruding portions are brought into contact with the inner wall 94*h* in different phases with respect to the phase in which the rotating shaft 95 receives a reaction force from the inner wall 94*i* of the toner conveying portion 92 through the stirring member 96. By doing so, it is possible to suppress the rubbing of the toner per one protruding portion. The shape of each of the plurality of protruding portions arranged in such a manner is not limited to the shape of the protruding portion 95*a* of the present embodiment, and the shapes of the protruding portion of each of the modification examples shown in FIGS. 10A to 10C may be adopted. Further, an arrangement configuration may be used in which a plurality of protruding portions 95*a* of the present embodiment and protruding portions of each modification example shown in FIGS. 10A to 10C are combined.

According to the present embodiment, in this way, the deformation of the rotating shaft can be suppressed in the stirring unit provided with the stirring member on the rotating shaft. This makes it possible to provide a toner conveying device and an image forming apparatus in which toner can be efficiently stirred and conveyed and toner sticking is less likely to occur even in a high-temperature environment.

In the present embodiment, the configuration of the stirring unit is applied to the cleaning unit of the intermediate transfer belt in the image forming apparatus, but this application is not limiting. The above configuration can also be applied to a configuration in which toner is stored inside and requires stirring, for example, a developing device provided with a toner storage container and a drum cleaning unit.

Further, in the present embodiment, a case is explained in which the free end of the stirring member 96 comes into contact with a part of the inner wall 94*i* as a constituent portion inside the rotation trajectory Rm in the inner surface configuration of the toner conveying portion 92. It goes without saying that the same effect can be obtained when the free end of the stirring member 96 comes into contact with a part of the upper surface portion of the urethane rubber 91*a* or the inner wall 94*h* of the container body 94.

Further, when the protruding portion 95*a* comes into contact with the inner wall 94*h* due to the bending of the rotating shaft 95, where the rotation of the rotating shaft 95 is restarted, the downstream end portion of the protruding portion 95*a* may interfere with the upstream end portion of the inner wall 94*i* downstream of the inner wall 94*h*. However, since the protruding portion 95*a* is provided in a very partial region in the longitudinal direction of the rotating shaft 95, a state will be assumed in which the protruding portion will be caused to run on the inner wall 94*i* by the reaction force received from the upstream end portion of the inner wall 94*i* and the rotational force of the rotating shaft 95, and the rotation of the rotating shaft 95 will not be hindered. That is, the protruding portion 95*a* applies to the rotating shaft 95 a force returning the point OO that is the center of rotation of the rotating shaft 95, which has been displaced due to the bending of the rotating shaft 95, to the point O, and the bending state of the rotating shaft 95 can be eliminated.

Embodiment 2

Embodiment 2 of the present invention will be described with reference to FIGS. 12 to 17, 19A, and 19B. In Embodiment 2, only the shapes of the container body and the stirring unit in the toner conveying portion 92 are different from those of Embodiment 1, and the other parts are the same as those of Embodiment 1. The description of the configuration in Embodiment 2 that is common to Embodiment 1 will be omitted.

Here, the toner conveying portion in the present embodiment is denoted by 92, the container body is denoted by 940, the stirring unit is denoted by 970, the rotating shaft is denoted by 950, the protruding portion corresponding to 95*a* of Embodiment 1 is denoted by 950*a*, and portions corresponding to 95*b* and 95*c* are denoted by 950*b* and 950*c*.

Figure 12:
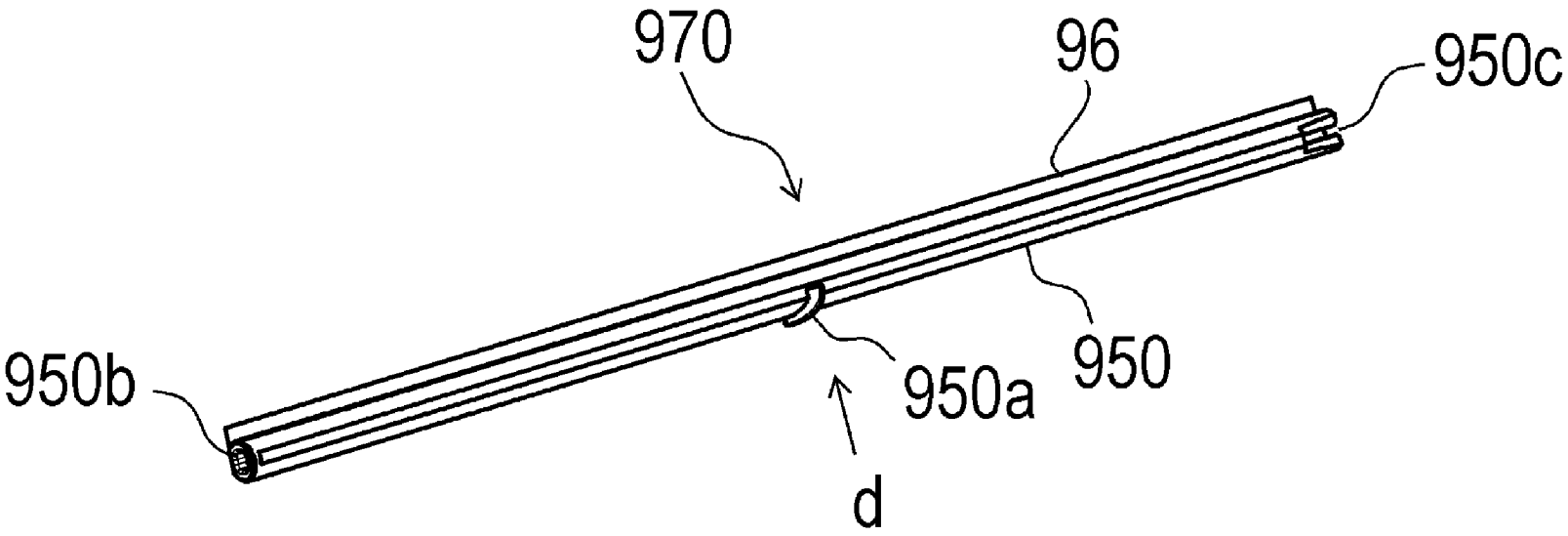
FIG. 12 is a schematic perspective view showing the configuration of the stirring unit.
Figure 13:
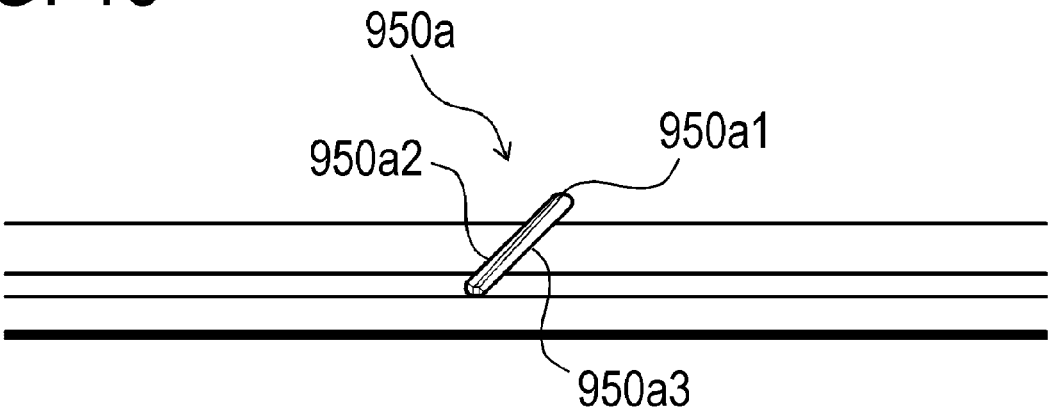
FIG. 13 is a schematic arrow view showing a part of the stirring unit.

FIG. 12 is a schematic perspective view of the stirring unit 970, and FIG. 13 is a view from the direction of arrow d shown in FIG. 12. The rotating shaft 950 is provided with the protruding portion 950*a* in the central portion in the longitudinal direction. The protruding portion 950*a* has the same shape as that shown in FIG. 10B of Embodiment 1. As shown in FIG. 13, the protruding portion 950*a* is composed of a curved surface 950*a*1 coaxial with the axis of the rotating shaft 950 when viewed from the axial direction of the rotating shaft 950, and flat surfaces 950*a*2 and 950*a*3 that are inclined with respect to the rotation axis when viewed from the direction perpendicular to the axis (direction of arrow d).

Figure 14:
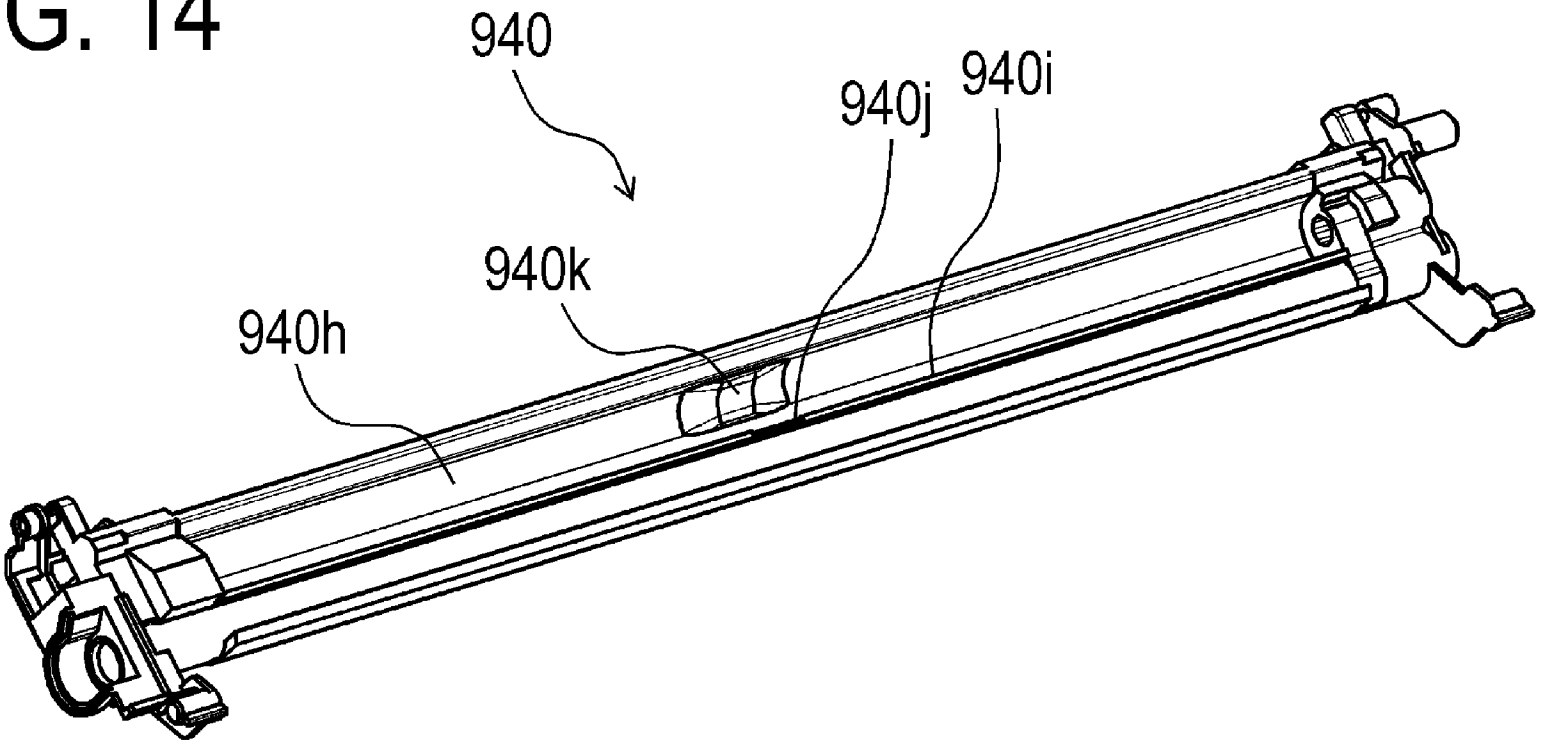
FIG. 14 is a schematic perspective view of a container body.
Figure 15:
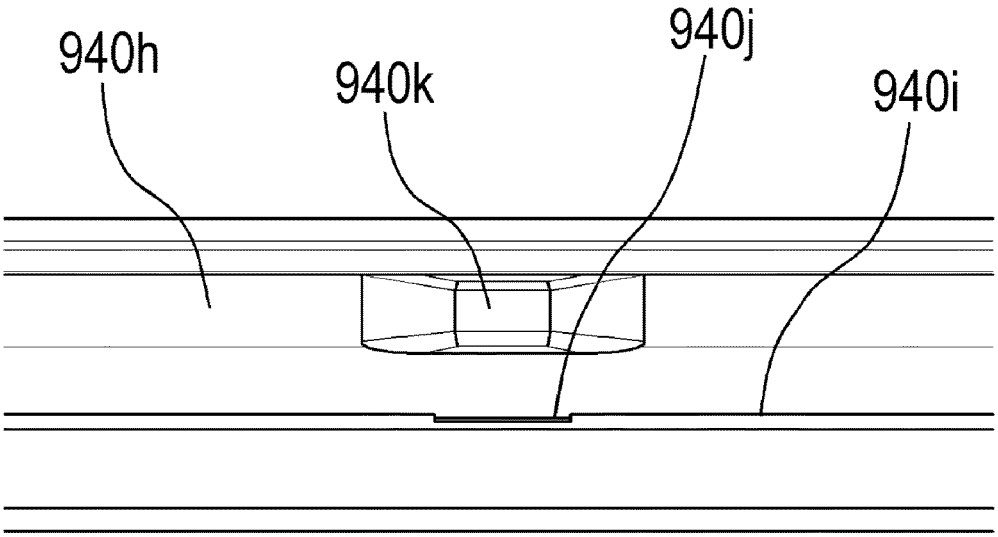
FIG. 15 is a schematic enlarged view showing the central portion in the longitudinal direction of the container body.
Figure 16:
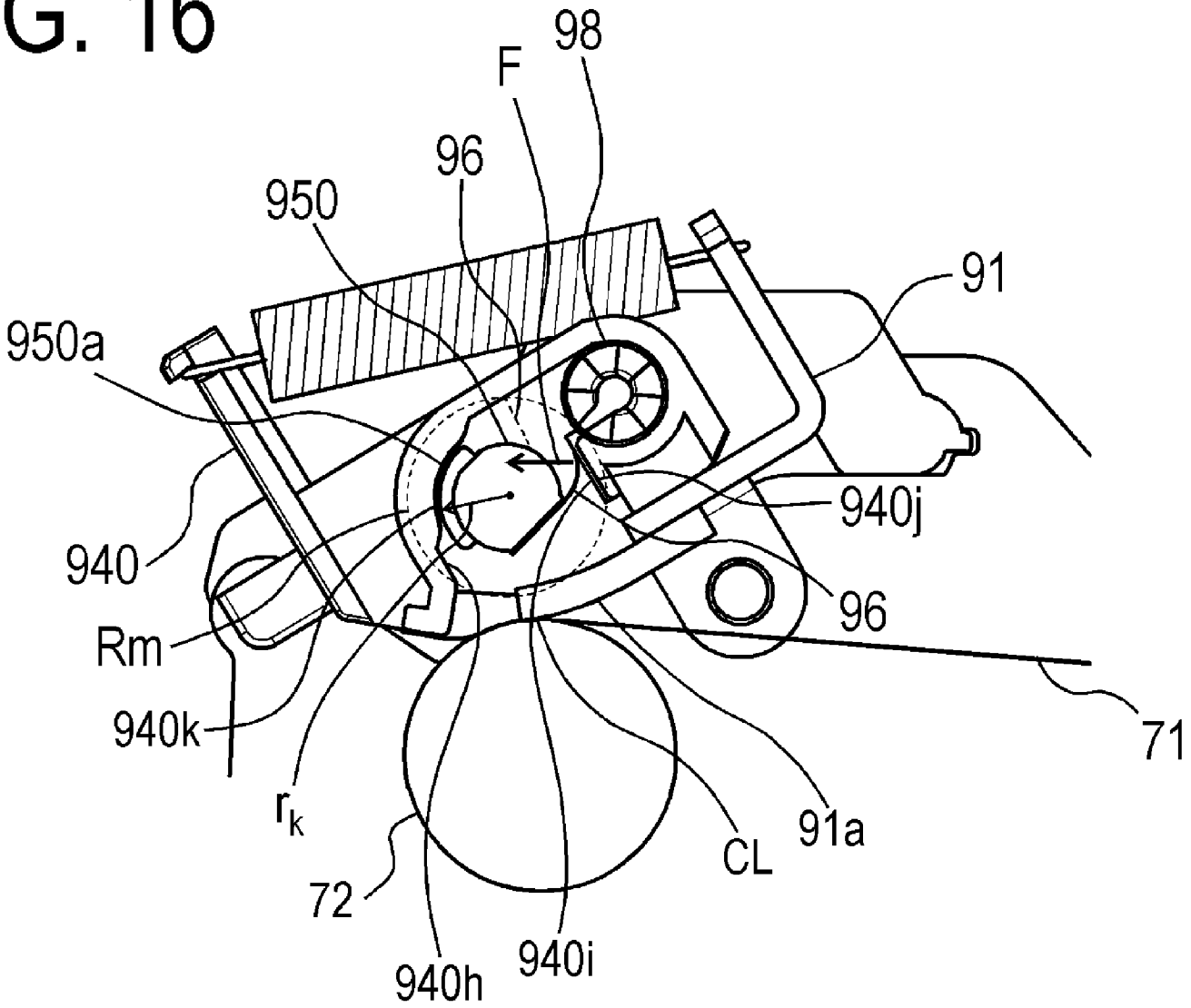
FIG. 16 is a schematic cross-sectional view showing the configuration of the toner convey unit.
Figure 17:
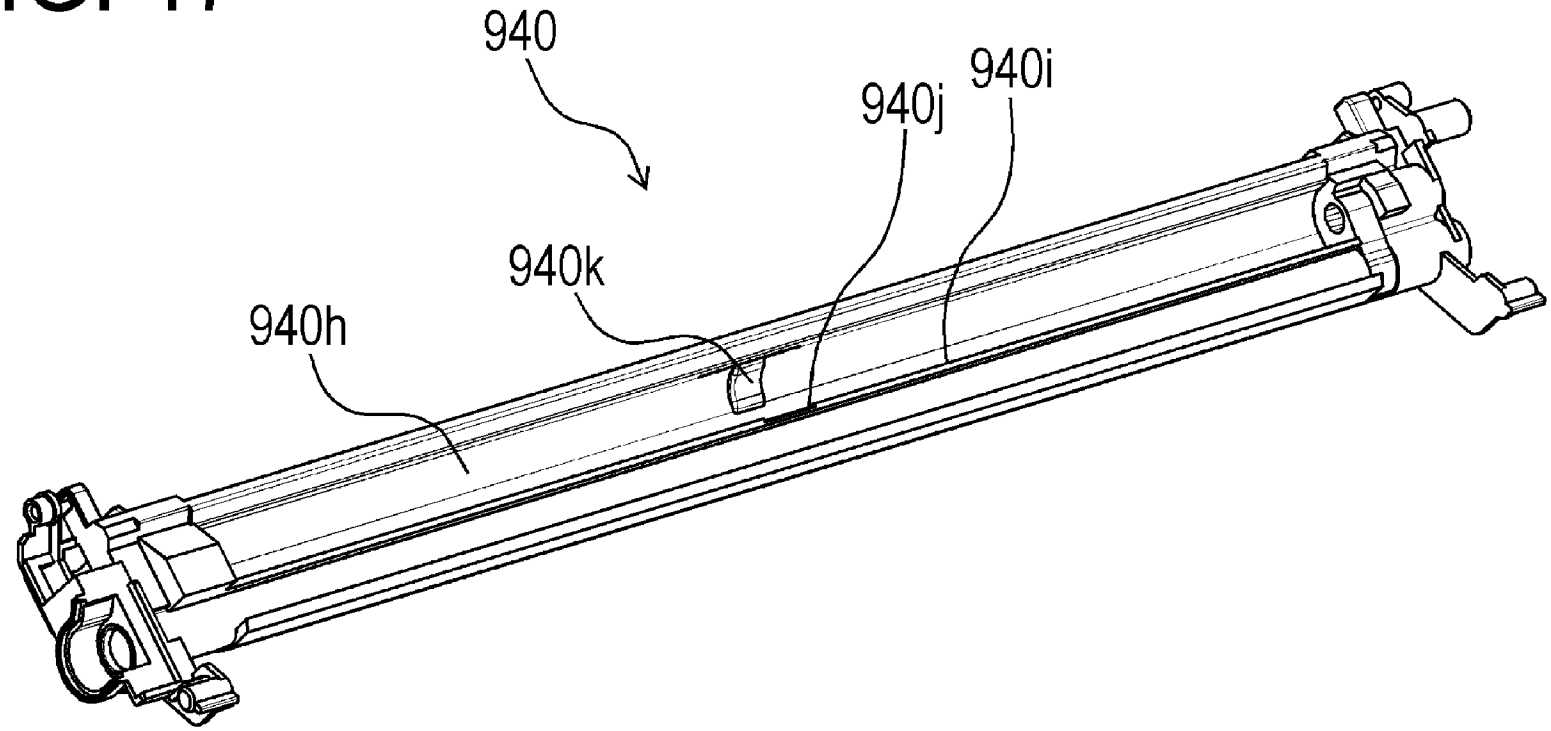
FIG. 17 is a schematic perspective view of the container body.

FIG. 14 is a schematic perspective view of the container body 940. FIG. 15 is an enlarged view of the central portion in the longitudinal direction of the container body 940, and FIG. 16 is a schematic cross-sectional view of the toner conveying portion 92 as viewed from the rotation axis direction of the stirring member 96, this cross section being viewed from the same direction as in FIGS. 6, 7, 8A, and 8B of Embodiment 1. As shown in FIGS. 12 to 16, in the present embodiment, a gentle protruding shape 940*k* (convex portion) is provided at a portion facing the protruding portion 950*a* in the longitudinal direction of the inner wall 940*h* of the container body 940. In the present embodiment, the protruding shape 940*k* has a curved surface coaxial with the inner wall 940*h*, and the radius thereof is $r_k$.

As described above, in Embodiment 1, the "radius of $Rm-r_h$" is set to be larger than the "clearance between the protruding portion 95*a* and the wall 94*h*". In other words, $$(\text{radius of } Rm-r_h)>(r_h-r_a) \quad (1)$$

$$r_a>(2r_h-\text{radius of } Rm) \quad (2)$$

In such a case, even when the rotating shaft 95 receives a reaction force from a part of the toner conveying portion 92 and bends due to creep deformation, the stirring member 96 is configured to be in reliable contact with the wall 94*h* in a desired phase.

Here, in the present embodiment, as a result of providing the protruding shape 940*k*, when the creep deformation as described in Embodiment 1 occurs, the protruding portion

950*a* comes into contact with the protruding shape 940*k* before coming into contact with the inner wall 940*h* and will not be able to deform any further. Therefore, in the present embodiment, $r_h$ in the formula (2) can be replaced with $r_k$.

$$r_a > (2r_k - \text{radius of } Rm) \quad (3)$$

Since $r_k$, which is the radius of the protruding shape 940*k* from the center O, is smaller than the radius $r_h$ of the inner wall 94*h*, the protrusion amount of the protruding portion 950*a*, that is, the radius $r_a$ of the protruding portion 950*a* can be reduced by providing the protruding shape 940*k*.

Here, as described above, since the toner melts when the temperature rises a certain level or higher, it is preferable not to configure the toner conveying portion 92 so that the toner is continuously rubbed in the minute gap between the rotating shaft 950 and the facing member and frictional heat is accumulated.

By partially protruding the inner wall 940*h* as in the present embodiment, it is possible to reduce the protrusion amount of the protruding portion 950*a* that comes into contact with the inner wall 940*h* when the amount of deformation due to creep becomes equal to or above a certain level. As a result, the clearance between the protruding portion 950*a* during rotation of the stirring unit 970 and the inner wall 940*h* other than the protruding shape 940*k*, or the surrounding internal parts of the toner conveying portion 92 in the radial direction with respect to the rotation axis of the rotating shaft 950 is increased, and frictional heat can be prevented from increasing.

Further, in order to increase the clearance with the protruding portion 950*a* during rotation and reduce frictional heat, it is preferable that the presence range of the protruding shape 940*k* in the rotation direction be the minimum necessary. In other words, only the section of the toner conveying portion 92 that comes into contact with the protruding portion 950*a* at the time of creep deformation may be caused to protrude. That is, the stirring member 96 is brought into contact with the inner wall 940*i* at a location in the toner conveying portion 92 where the distance to the rotating shaft 950 is short and creep deformation of the rotating shaft 950 due to contact of the stirring member 96 with the inner wall 940*i* is a concern. The rotating shaft 950 may be bent by the reaction force generated by the contact, that is, may be pushed to the side substantially opposite to that of the free end of the stirring member 96.

Figure 19A:
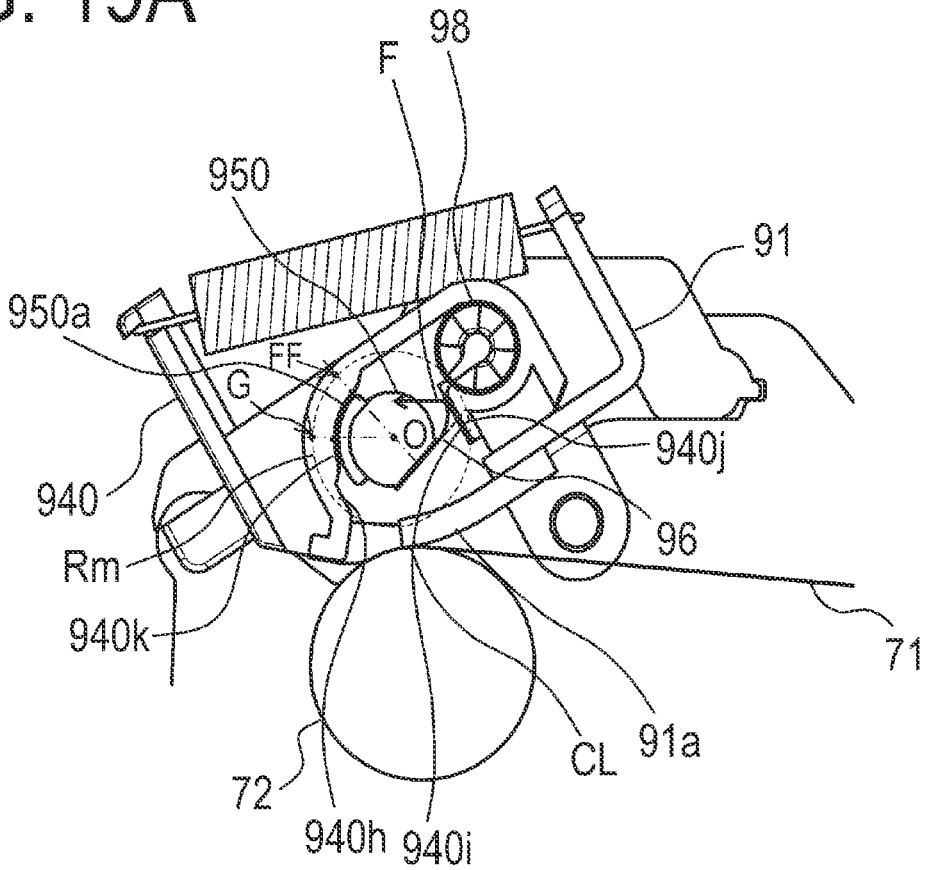
FIGS. 19A and 19B are diagrams showing the state of the rotating shaft and the stirring member in Embodiment 2.
Figure 19B:
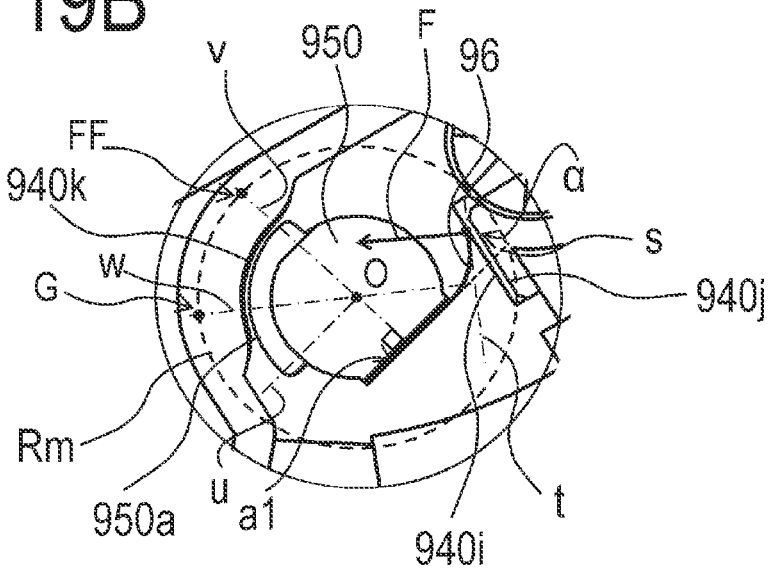

FIGS. 19A and 19B show the rotating shaft 950 and the stirring member 96 in a state where the stirring member 96 is in contact with the inner wall 940*i*, which is one of the phases in which creep deformation is a concern in the present embodiment. FIG. 19B is a partially enlarged view of FIG. 19A. The restoring force of the rotating shaft 950 at this time acts between the normal direction to the stretching direction (broken line s) of the stirring member 96 in the undeformed state and the normal direction to the tangent in the contact portion (contact point) at the time the stirring member 96 contacts the inner wall 940*i*.

Therefore, the protruding shape 940*k* may be provided in the following range. That is, a point where a straight line v that passes through the center O of the rotating shaft 950 and is perpendicular to the stretching direction (broken line s in FIG. 19B) of the stirring member 96 in the undeformed state is in contact with the rotation trajectory Rm on the side opposite to the contact portion of the stirring member 96 with respect to the central point O of the rotating shaft 950 is denoted by FF. A point where a straight line w that is perpendicular to the tangent line (dotted chain line t in FIG. 19B) at the contact portion (contact point) at the contact time of the stirring member 96 is in contact with the rotation trajectory Rm on the side opposite to the contact portion of the stirring member 96 with respect to the central point O of the rotating shaft 950 is denoted by G. With such settings, the protruding shape 940*k* may be between the line segment OG and the line segment OFF in the rotation direction of the rotating shaft 950.

Here, in the present embodiment, the phase where the distance to the rotating shaft 950 is short and creep deformation is a concern is substantially the entire phase where the stirring member 96 contacts the inner wall 940*i*. Therefore, it is preferable that the protruding shape 940*k* be in the above range in each such phase. As a result, in the present embodiment, the protruding shape 940*k* is provided as shown in FIGS. 19A and 19B.

Further, as shown in FIG. 13, the protruding portion 950*a* is configured to be inclined rather than perpendicular to the axial direction of the rotating shaft 950 and exerts a toner conveying force in the axial direction. As the rotating shaft 950 rotates, the peripheral toner is pushed away by the flat surface 950*a*2 on the downstream side of the protruding portion 950*a* in the rotation direction, and the toner that has been rubbed between the protruding portion 950*a* and the toner conveying portion 92 and has generated frictional heat is prevented from being rubbed again. At this time, by making the direction in which the toner is pushed away and conveyed by the protruding portion 950*a* the same as the toner conveying direction by the screw 98, it is possible to convey the toner more efficiently toward the toner conveyance path 761.

Further, as shown in FIGS. 14 and 15, the inner wall 940*i* is provided with a surface 940*j* that escapes in a direction away from the rotating shaft 950 beyond the inner wall 940*i* at a portion facing the protruding portion 950*a* in the longitudinal direction. As a result, the clearance between the protruding portion 950*a* and the inner wall of the container body 940 can be further ensured. Meanwhile, as shown in FIG. 14, since the surface 940*j* is provided in a part of the central portion in the longitudinal direction, the posture of the stirring member 96 does not change significantly under the effect of the surface 940*j*.

In the present embodiment, the protruding shape 940*k* is formed to have a gentle shape such that when the stirring member 96 passes by the protruding shape 940*k* during rotation, the free end side of the stirring member 96 follows the protruding shape 940*k* while deforming in the longitudinal direction. As a result, the tip of the stirring member 96 rotates without being separated from the inner wall 940*h* or the protruding shape 940*k*, and the toner conveying ability is not deteriorated.

The shapes of the protruding shape 940*k* and the protruding portion 950*a* of the present embodiment are not limited to those described hereinabove. For example, the protruding shape 940*k* of the present embodiment and the protruding portion 95*a* shown in Embodiment 1 may be combined. Further, the protruding shape 940*k* shown in FIG. 17 does not have a gentle slope like the protruding shape 940*k* shown in FIG. 14, and only the portion in contact with the protruding portion is projected, but such shape may be combined with the shape of the protruding portions 95*a* and 950*a*.

Further, the protruding portion shape of each of the modification examples shown in FIGS. 10A to 10C may also be adopted in the present embodiment, and a plurality of protruding shapes 940*k* may be arranged in accordance with the configuration of a plurality of protruding portions arranged as shown in FIGS. 11A and 11B.

In this way, according to the present embodiment, the deformation of the rotating shaft can be suppressed in the stirring unit provided with the stirring member on the rotating shaft. This makes it possible to provide a toner conveying device and an image forming apparatus in which toner can be efficiently stirred and conveyed and toner sticking is less likely to occur even in a high-temperature environment.

The configurations of each of the above-described embodiments and modification examples may be combined with each other as long as there is no technical contradiction. In the present embodiment, the container configuration example is explained in which the inner surface forming the toner accommodation space in the toner container can have a sliding phase of sliding contact with the stirring member and a non-sliding phase without sliding, but the container configuration to which the present invention is applicable is not limited to this configuration. For example, the present invention is also suitably applicable to a toner conveying device having a container inner surface configuration having no non-sliding phase, that is, a container configuration in which a sliding member is always in contact with the container inner surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2021-077366, filed on Apr. 30, 2021, and No. 2022-017269, filed on Feb. 7, 2022, which are hereby incorporated by reference herein in their entirety.

What is claimed is:

1. A toner conveying device comprising:

a container configured to accommodate toner;

a rotating member that is rotatably provided inside the container and extends in a direction of a rotation axis of the rotating member, the rotating member having a protruding portion that protrudes in a direction perpendicular to the direction of the rotation axis; and a flexible sheet-shaped stirring member provided on the outer periphery of the rotating member and fixed at one end portion to the rotating member, the stirring member being capable of stirring the toner by rotating the rotating member, wherein the stirring member comes into contact with the inner surface of the container and deforms as the rotating member rotates, wherein in a rotation trajectory formed by the rotation of the rotating member in a case where the rotating member is viewed in a cross section orthogonal to the rotation axis, wherein a line segment connecting a free end of the stirring member in a state, in which the free end is in contact with the inner surface of the container and is not deformed, and the rotation center of the rotating member is defined as a radius of the rotation trajectory, in a case where a phase, in which the free end is in contact with the inner surface of the container and is deformed, is defined as a first phase, and a phase, in which the free end is not in contact with the inner surface of the container is defined as a second phase, where a region, in which the free end is arranged in a state in which the free end is located in the first phase in a case where the rotation trajectory is divided into two by a first straight line, which is parallel to the stretching direction of the stirring member and passing through the rotation center of the rotating member, is defined as a first region, and a region on an opposite side to the first region across the first straight line is defined as a second region, wherein the protruding portion is partially provided in the circumferential direction of the rotating member, and at least a part of the protruding portion is provided between a first position in which a second straight line that is perpendicular to the first straight line and passes through the rotation center of the rotating member crosses the rotation trajectory and is located in the second region in the rotation direction of the rotating member, and a second position in which, in a case the rotation trajectory divided in two by a third straight line, the third straight line is crossed the rotation trajectory and is located in the second region, and in the first phase, the straight line that is perpendicular to a contact line passing through a contact point formed by the inner surface of the container and the stirring member in a state of deformation of the stirring member, passes through the rotation center and crosses the rotation trajectory is defined as the third straight line, wherein the container has a contact portion with which the stirring member comes into contact on the inner surface, and wherein the protruding portion protrudes from the outer peripheral surface of the rotating member toward the inner surface of the container, the protruding portion is provided in a region on a substantially opposite side to the contact portion on the outer peripheral surface of the rotating member, across the rotation axis, and the protruding portion is in contact with the inner surface in a case where the rotating member is stopped and the stirring member is in contact with the contact portion.

2. The toner conveying device according to claim 1, wherein the protruding portion includes a portion located in a region on the opposite side to a side where the contact portion is located with respect to a second virtual line orthogonal to a first virtual line passing through the contact portion and the rotation axis in the cross section orthogonal to the rotation axis.

3. The toner conveying device according to claim 2, wherein the portion of the protruding portion intersects the first virtual line.

4. The toner conveying device according to claim 2, wherein in the portion of the protruding portion, an angle around the rotation axis between an end portion on one side in the circumferential direction of the outer circumference of the rotating member and an end portion on the other side is more than 90 degrees.

5. The toner conveying device according to claim 1, wherein the protruding portion is separated from the inner surface while the rotating member rotates.

6. The toner conveying device according to claim 1, wherein the inner surface of the container has a shape such that the distance to the rotation axis in the direction perpendicular to the rotation axis of the rotating member varies so that the stirring member can have the first phase and the second phase, as the rotating member rotates.

7. The toner conveying device according to claim 1, wherein the protruding portion is provided at a position away from the end portion of the rotating member in the direction of the rotation axis.

8. The toner conveying device according to claim 1, wherein the protruding portion is provided substantially in the center of the rotating member in the direction of the rotation axis.

9. The toner conveying device according to claim 1, wherein the protruding portion is provided in plurality at intervals in the direction of the rotation axis.

10. The toner conveying device according to claim 1, wherein the protruding portion is provided on the outer peripheral surface of the rotating member so as to extend along the rotation direction of the rotating member.

11. The toner conveying device according to claim 1, wherein the protruding portion is provided on the outer peripheral surface of the rotating member so as to extend in a direction inclined with respect to the rotation direction of the rotating member.

12. The toner conveying device according to claim 11, wherein a side surface of the protruding portion is composed of a curved surface that forms a part of a screw having an ability to convey the toner in the direction of the rotation axis.

13. The toner conveying device according to claim 11, wherein a side surface of the protruding portion is configured of a surface extending in a direction inclined with respect to each of the direction of the rotation axis and the direction perpendicular to the rotation axis.

14. The toner conveying device according to claim 11, wherein the toner conveying device further includes a conveying member that conveys the toner in a first direction parallel to the rotation axis inside the container; wherein the rotating member rotates counterclockwise about the rotation axis in a case of being viewed in a second direction opposite to the first direction; and wherein the protruding portion is inclined so that the position in the rotation direction changes from the upstream side to the downstream side in the rotation direction toward the second direction.

15. The toner conveying device according to claim 1, wherein the protruding portion is provided on the outer peripheral surface of the rotating member so as to extend spirally with respect to the rotation axis.

16. The toner conveying device according to claim 1, wherein the protruding portion has a plurality of projections arranged side by side in an extension direction on the outer peripheral surface of the rotating member so that a plurality of peaks of the protrusion height is formed in the extension direction.

17. The toner conveying device according to claim 1, wherein the inner surface of the container has a convex portion that protrudes toward the rotation axis at a position corresponding to the protruding portion in the direction of the rotation axis, and wherein the convex portion faces the protruding portion in a state where the stirring member is in contact with the contact portion.

18. The toner conveying device according to claim 1, wherein in the cross-section perpendicular to the rotation axis, where the distance from the rotation axis to the free end in a radial direction through the rotation axis as a center in a state where the stirring member is not deformed as a result of the free end receiving an external force is denoted by Rm, the distance in the radial direction from the rotation axis to a position in which the stirring member is in contact with the inner surface in a state where the stirring member is in contact with the contact portion is denoted by $r_h$, and the distance in the radial direction from the rotation axis to the tip of the protruding portion is denoted by $r_a$, following formulas are satisfied:

$$(Rm-r_h)>(r_h-r_a) \quad (1)$$

$$r_a>(2r_h-Rm) \quad (2).$$

19. An image forming apparatus comprising:

an image forming portion including an image bearing member that bears a toner image and a transfer unit for transferring the toner image from the image bearing member to a transfer target;

a cleaning unit for removing the toner from the image bearing member; and a toner collecting device that collects the toner removed from the image bearing member by the cleaning unit, wherein the toner collecting device includes the toner conveying device according to claim 1.

20. The image forming apparatus according to claim 19, wherein the toner collecting device includes a collecting container for accommodating the toner removed from the image bearing member by the cleaning unit, and the toner conveying device conveys the toner removed from the image bearing member by the cleaning unit to the collecting container.

21. The image forming apparatus according to claim 19, wherein the toner conveying device is arranged near a heat source in the image forming apparatus.

22. The image forming apparatus according to claim 19, further comprising:

a fixing device that heats the toner image transferred to a recording material as the transfer target and fixes the toner image to the recording material, wherein the toner conveying device is arranged in the vicinity of the fixing device.

23. The image forming apparatus according to claim 19, wherein the image bearing member is an intermediate transfer belt.

* * * * *